US009822483B2

(12) United States Patent
Faufau et al.

(10) Patent No.: US 9,822,483 B2
(45) Date of Patent: Nov. 21, 2017

(54) DECKLE BOARD SYSTEM WITH A BOUNDARY LAYER SHOWER AND METHOD

(71) Applicant: IBS of America, Chesapeake, VA (US)

(72) Inventors: James Faufau, Big Canoe, GA (US); Andrew Forester, Schoolcraft, MI (US)

(73) Assignee: IBS of AMERICA, Chesapeake, VA (US)

( * ) Notice: Subject to any disclaimer, the term of this patent is extended or adjusted under 35 U.S.C. 154(b) by 0 days.

(21) Appl. No.: 15/155,252

(22) Filed: May 16, 2016

(65) Prior Publication Data

US 2016/0348313 A1 Dec. 1, 2016

Related U.S. Application Data

(60) Provisional application No. 62/168,326, filed on May 29, 2015.

(51) Int. Cl.
*D21F 9/02* (2006.01)
*D21F 1/56* (2006.01)

(52) U.S. Cl.
CPC ..... *D21F 1/56* (2013.01)

(58) Field of Classification Search
CPC ... D21F 9/02; D21F 1/56; D21F 1/486; D21F 7/00
USPC ..... 162/353
See application file for complete search history.

(56) References Cited

U.S. PATENT DOCUMENTS

| | | | |
|---|---|---|---|
| 1,712,632 | A | 5/1929 | Peterson et al. |
| 2,305,300 | A | 12/1942 | Lowe |
| 3,405,031 | A | 10/1968 | Sisson |
| 3,607,624 | A | 9/1971 | Moody et al. |
| 4,124,441 | A | 11/1978 | Nykopp |
| 4,738,751 | A | 4/1988 | Newcombe |
| 4,968,387 | A | 11/1990 | Beran et al. |
| 5,045,154 | A | 9/1991 | Baluha |
| 5,269,884 | A | 12/1993 | Peterson |
| 5,298,127 | A | 3/1994 | Beran |
| 5,302,250 | A | 4/1994 | Peterson et al. |
| 6,146,502 | A | 11/2000 | Marx |
| 6,470,598 | B2 | 10/2002 | Ringer |
| 6,702,925 | B2 | 3/2004 | Bricco et al. |
| 7,169,262 | B2 | 1/2007 | Bricco et al. |
| 8,236,139 | B1 | 8/2012 | Reed |

(Continued)

FOREIGN PATENT DOCUMENTS

| | | | |
|---|---|---|---|
| DE | 102008059681 | A1 | 6/2009 |
| EP | 2907918 | A1 | 8/2015 |

OTHER PUBLICATIONS

Potentially Related U.S Appl. No. 14/618,053, filed Feb. 10, 2015.

(Continued)

*Primary Examiner* — Mark Halpern
(74) *Attorney, Agent, or Firm* — The Dobrusin Law Firm, P.C.; Daniel P. Aleksynas

(57) ABSTRACT

A system comprising: one or more deckle board that extend along a machine direction of a paper machine, and a boundary layer shower that is located proximate to each of the one or more deckle board systems and directs a fluid unto a stock side face of the one or more deckle boards so that a boundary layer of fluid is formed between the one or more deckle boards and stock.

19 Claims, 24 Drawing Sheets

(56) References Cited

U.S. PATENT DOCUMENTS

| | | | | |
|---|---|---|---|---|
| 8,685,209 | B2 | 4/2014 | Faufau et al. | |
| 9,045,859 | B2 | 6/2015 | Gauss et al. | |
| 2015/0225897 | A1* | 8/2015 | Forester | D21F 1/56 162/310 |

OTHER PUBLICATIONS

Peterson, R. S., "Improving Basis Weight Uniformity with Deckle Wave Control", Tappi Journal, Technical Association of the Pulp & Paper Industry. Atlanta, US, vol. 75, No. 7, Jul. 1, 1992, pp. 121-128.

* cited by examiner

DECKLE BOARD SYSTEM WITH A BOUNDARY LAYER SHOWER AND METHOD

FIELD

The present teachings relate to an improved deckle board system and particularly an improved deckle board system including a boundary layer shower for forming a deckled edge with a low variation.

BACKGROUND

Typically, fourdrinier paper machines include a wet end with a wire that moves in a machine direction. The wire has a width and stock is applied substantially along the entire width of the wire. A deckle may be used on both edges of the wire to retain substantially all of the stock on the wire. Deckle boards are used to create an edge on a paper machine and to retain stock, water, fines, filler, or a combination thereof on the wire of the paper machine. Some paper machines include a static board that sits on an edge of the wire and prevents stock from exiting the wire from the cross machine direction. Other systems use water to cut the stock and/or slightly dried stock to form an edge on the wire. However, removing stock from the edges decreasing the width of the paper machine resulting in less tons per hour being run. Further, pushing the stock along the cross machine direction may result in an uneven formation along the edges and even towards the center of the sheet so that the sheet includes inconsistencies, which may lead to edges and/or paper being rejected. Pushing stock from the edges of the paper machine may result in waves being sent from one side of the paper machine towards the other side of the paper machine.

Examples of devices for deckling edges of paper are disclosed in U.S. Pat. Nos. 1,712,632; 2,305,300; 3,607,624; 4,738,751 and 4,968,387; U.S. patent application Ser. No. 14/618,053, filed on Feb. 10, 2015; and U.S. Provisional Patent Application No. 61/939,477 filed on Feb. 13, 2014 and 61/939,793, filed on Feb. 14, 2014 all of which are expressly incorporated herein by reference for all purposes. Thus, there is a need for a device that maximizes the width of the paper machine so that substantially all of the paper along the width of the paper machine may be used. What is needed is a device that removes inconsistencies from the edges of the paper machine. What is needed is a shower that prevents waves from traveling in the cross machine direction. What is needed is a shower that creates a boundary layer along a face of a deckle board so that boundary waves are not created at the along the deckle board. What is needed is a device that remains substantially planar as the temperatures along the paper machine vary or from varying paper machine temperatures.

SUMMARY

One possible embodiment of the present teachings provide a system comprising: one or more deckle board that extend along a machine direction of a paper machine, and a boundary layer shower that is located proximate to each of the one or more deckle board systems and directs a fluid unto a stock side face of the one or more deckle boards so that a boundary layer of fluid is formed between the one or more deckle boards and stock.

The present teachings provide a deckle board system that may including one or more of the following features:

wherein the microstructure is sufficiently sized and shaped so that the turbulent flow only affects the first 20 mm or less, preferably, 10 mm or less, or even more preferably 5 mm or less from the stock side of the deckle board in the cross machine direction; wherein an entire length of the stock side includes the microstructure; wherein the microstructure is round, octagonal, square, hexagonal, pentagonal, nonagonal, a polygon, or a combination thereof; wherein the deckle board has a substantially continuous surface that is free of recesses, ledges, flat spots, or a combination thereof where water, stock, fiber, or a combination thereof can build up; wherein the one or more seal strips are retained within the deckle board by one or more spring washers that control tension on the one or more seal strips; wherein the deckle board is connected to a head box or a region proximate to the head box so that movement of the deckle board in a direction opposite that of the machine direction is prevented; wherein the deckle board includes one or more guide grooves; wherein the one or more guide grooves is located along the non-stock side of the deckle board; wherein the one or more guide grooves are interrupting T-slots that include T-slots and T-interruptions; wherein the one or more guide grooves are configured to receive a slide, a T-nut, or both that is movable along the one or more guide grooves, allows movement of the deckle boards in the machine direction, or both; wherein during thermal expansion of the deckle boards the deckle boards move relative to the T-nuts in the machine direction and the vertical stands are rotated in the machine direction so that the deckle board is expandable to remain substantially linear, is free of waving, non-linear portions, or a combination thereof; wherein a top of the deckle board includes a radius and the radius is configured so that a water curtain flows evenly on the stock side and the non-stock side of the deckle board; wherein the radius is sufficient so that water sprayed on the deckle board forms a curtain so that the stock side and the non-stock side remain substantially clean; wherein the deckle board only has one fixed anchoring point and the fixed anchoring point is proximate to the head box, is connected to the head box, or both; wherein the deckle board is free of any angled portions; wherein the showers include one or more shower bars and each of the shower bars include one or more holes, one or more shower nozzles, or both for generating a spray; wherein the one or more slots are a single connection slot for receiving a connection fastener; wherein a pressure fastener is located proximate to each of the plurality of expansion slots; wherein the chamfer is 10 degrees or more, 20 degrees or more, 45 degrees or more from vertical; wherein the deckle board can be adjusted from vertical to an angle of ±5 degrees or more, ±10 degrees or more, ±25 degrees or more; wherein the chamfer the angle of the deckle board, or both accelerates stock and creates turbulence that prevents a generation of a boundary layer, waves, or both; or a combination thereof.

The present teachings provide a method comprising: (a) attaching the system of the teachings herein to the paper machine; (b) adjusting each of a plurality of stand assemblies so that a distance of each of the deckle boards from a vertical stand of each of the plurality of stand assemblies decreases relative to the stand assemblies upstream so that the deckle boards diverge in the cross-machine direction as the deckle boards extend in the machine direction.

The present teachings provide a device that maximizes the width of the paper machine so that substantially all of the paper along the width of the paper machine may be used. The present teachings provide a device that removes inconsistencies from the edges of the paper machine. The present teachings provide a shower that prevents waves from traveling in the cross machine direction. The present teachings provide a shower that creates a boundary layer along a face of a deckle board so that boundary waves are not created at the along the deckle board. The present teachings provide a device that remains substantially planar as the temperatures along the paper machine vary or from varying paper machine temperatures.

DETAILED DESCRIPTION

Figure 1:
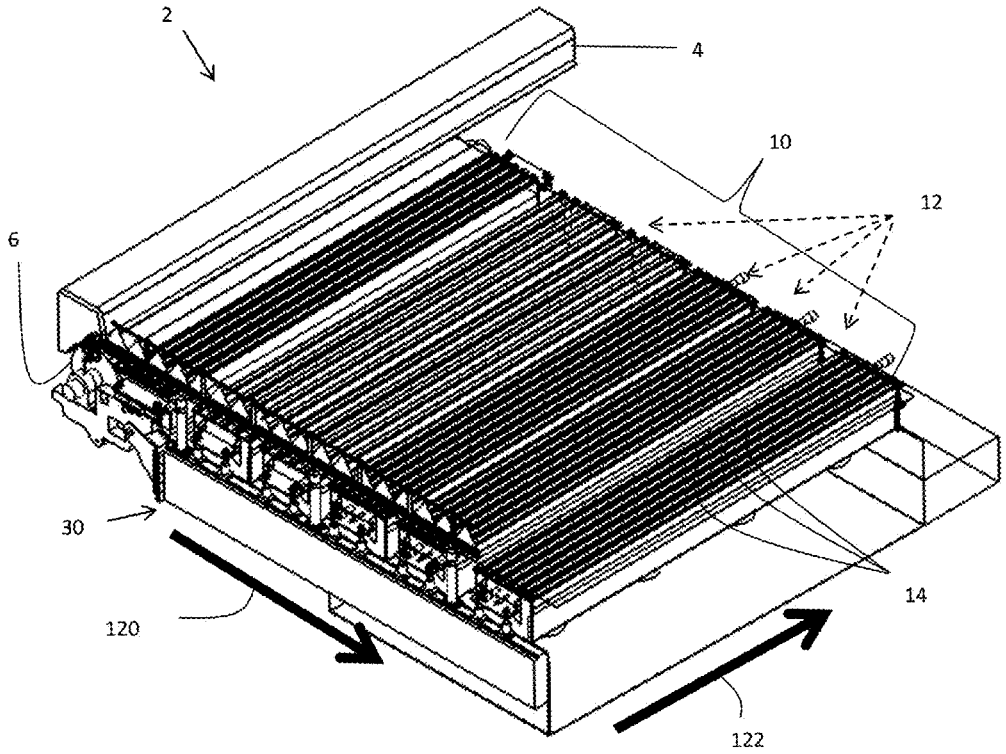
FIG. 1 illustrates a perspective view of a paper machine including a deckle system.

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present teachings are predicated upon providing an improved deckle system for a paper machine, and preferably a fourdrinier paper machine. The paper machine taught herein may be any paper machine that functions to create paper. The paper machine may be any style and/or type that forms paper with a deckled edge. The paper machine includes a head box that applies stock in a wet end. The head box may be gravity fed, pressurized, or both. The head box may function to apply stock to a wet end, above a breast roll, or both. The head box may function to apply stock to a forming board. The head box may apply stock proximate to a breast roll and a forming board.

The breast roll may be the first roll of the wet end (i.e., at the head box end), may assist in formation, may remove water from the stock, or a combination thereof. The breast roll may be the lead roll in a wet end. The wet end may function to receive stock and dewater stock. The wet end may have one or more and preferably a plurality of foil sections. The foil sections may each include one or more foils and preferably a plurality of foils. The foils may be height adjustable, angle adjustable, fixed, or a combination thereof. The foil sections may include one or more forming boards. The forming boards may be part of a forming board section. The forming board section may include height adjustable foils, angle adjustable foils, fixed foils, or a combination thereof. The wet end includes edges in a cross-machine direction. The wet end may have a wire that travels in a machine direction with stock and the stock is dewatered as the wire moves in the machine direction. Preferably, the wet end includes an endless wire that travels in a machine direction. The width of the wire may extend in the cross-machine direction. The wet end may have opposing edges that may have stock that runs along a cross-machine direction and falls off the wire. The wet end may end with a couch roll (i.e., couch roll end) that functions to wrap the wire and guide the wire in a direction opposite the machine direction so that an endless wire is formed. The couch roll may function to dewater. The couch roll may end the wet end. The couch roll may assist in guiding a sheet from the wet end into a press section.

The wet end may include a breast roll arm, a main frame, one or more end plates, one or more foil sections, one or more forming boards, one or more couch rolls, or a combination thereof. The main frame may be static and may connect the wet end of the paper machine to the ground. The main frame may be the bulk of the paper machine. The main frame may function to support all of the other elements of the paper machine, the wet end, or both. The main frame may support a pair of opposing breast roll arms, a plurality of end plates, or both. The end plates may connect the foil sections within the paper machine, may form an edge of the wire, or both. The end plates may be connected to the breast roll arm, the main frame, or both. The breast roll may be vertically movable, rotationally movable, or both. The deckle system may be connected to the breast roll arm, the main frame, or both. The deckle system may be connected to the breast roll arm, the main frame, or both and prevent stock from traveling in the cross machine direction.

A deckle board system (or deckle system) may prevent stock from falling off the wire in the cross-machine direction. The deckle system may function to maintain a straight edge of stock on a wire. The deckle system may function to maintain a substantially constant caliper, basis weight, or both in the cross-machine direction of the paper machine. The deckle board system may include one or more deckle boards, one or more shower systems, or both for maintaining an edge of the stock, the paper, or both in a line, for creating a substantially constant basis weight, a constant caliper, a constant fiber orientation, a random fiber orientation, or a combination thereof in the cross-machine direction. Preferably, the deckle board system includes one or more deckle boards on each side of the wet end that extend substantially the length of the wet end (e.g., from the head box to the couch roll).

The one or more deckle boards have a stock side and a non-stock side. The one or more deckle boards may contact the stock so that as the wire passes along the deckle boards the stock sides maintains the stock on the wire. Preferably, the stock side of the deckle boards is free of contact with stock due to a boundary layer of shower water, a boundary layer of turbulence, or both. The one or more deckle boards may be substantially linear, substantially planar, or both along their length. Preferably, the deckle boards or portions of the deckle boards are free of warp and/or non-linear portions due to thermal expansion. The one or more deckle boards may be made of any material that is resistant to corrosion, abrasion, or both by stock. The one or more deckle boards may be made of and/or include metal, plastic, natural materials, synthetic materials, nylon, nylon 6, delrin, ceramic, polyurethane, low density polyethylene, polyethylene terephthalate, or a combination thereof. Preferably, the one or more deckle boards may be made of polyethylene (UHMW-PE). The one or more deckle boards may be made of a material that expands and/or contracts due to thermal expansion. Preferably, the material of the deckle boards is substantially free of thermal expansion. The coefficient of linear thermal expansion of the deckle boards may be about 300 ($10^{-6}$ m/(m K)) or less, about 250 ($10^{-6}$ m/(m K)) or less, preferably about 200 ($10^{-6}$ m/(m K)), or even about 150 ($10^{-6}$ m/(m K)) or less. The one or more deckle boards may be expandable and/or contractible within the deckle board system so that the deckle boards are free of resistance and maintain a linear configuration and/or planar configuration. The one or more deckle boards may include one or more head box attachments that retain the deckle board substantially static and/or allow for thermal expansion in the machine direction as the deckle boards expand and contract.

The one or more head box attachments may function to locate the deckle board system, one or more shower systems, or both in the machine direction. The one or more head box attachments may prevent movement of the deckle board system in the machine direction. The one or more head box attachments may allow the deckle board system to thermally expand. The one or more head box attachments may provide one longitudinal connection point for the deckle board system. The one or more head box attachments may be located at a head box end of the deckle board system. The one or more head box attachments may anchor the deckle board system to the head box. The one or more head box attachments may align the deckle board with the wet end so that the deckle boards create a deckle edge. The one or more deckle boards may include one or more chamfers.

The one or more deckle boards may include one or more chamfers on the stock side, the non-stock side, or both. The one or more chamfers may have any angle so that a boundary layer is interrupted, a boundary layer is prevented, turbulence is created, or a combination thereof. The angle of the chamfer may be sufficient so that a boundary layer is interrupted, a boundary layer is prevented, turbulence is created, or a combination thereof. The angle may be sufficient so that any movement of stock (e.g., waves) in the cross-machine direction is dampened, eliminated, not reflected back in the machine direction, angled downward so that the stock movement is eliminated, or a combination thereof. The one or more chamfers may be a plurality of chamfers that the sum of the angles form one of the angles discussed herein. The chamfers may be one or more chamfers, two or more chamfers, three or more chamfers, or even four or more chamfers. The angle of the chamfer(s) may be about 5 degrees or more, about 15 degrees or more, about 25 degrees or more, or about 45 degrees or more. The chamfer(s) may be about 75 degrees or less, about 60 degrees or less, or about 50 degrees or less. The one or more deckle boards may be straight and may be angle adjustable.

The deckle board, associated parts holding the deckle board in place, or both may adjust the angle of the deckle board relative to the plane of the wet end, vertical, or both. The angle adjustment of the deckle board may function to create a straight deckled edge, prevent cross-machine movement of stock, maintain a constant caliper, maintain a constant basis weight, create turbulence, or a combination thereof. The angle of the deckle board may be adjusted so that the angle of a stock side face of the deckle board from vertical is sufficient so that a boundary layer is interrupted, a boundary layer is prevented, turbulence is created, or a combination thereof. The angle the stock side face may be adjusted is about ±5 degrees or more, about ±10 degrees or more, about ±15 degrees or more, about ±25 degrees or more from vertical. The angle the stock side face may be adjusted is about ±75 degrees or less, about ±60 degrees or less, or about ±45 degrees or less from vertical. Preferably, the angle is adjusted in the cross machine direction towards an opposing side of the paper machine. The one or more deckle boards may include a smooth surface, a surface with a microstructure, or both on the stock side, the non-stock side, or both.

The microstructure may function to eliminate laminar flow across the face of the deckle board. The microstructure may function to eliminate stock build up. The microstructure may function to create a boundary layer so that a substantially constant basis weight, caliper, or both are generated proximate to the deckle board. The microstructure may be any structure that functions to create eddies along the machine direction when the stock contacts the stock side of the one or more deckle boards. The microstructure may be microscopic indentations within a surface of the deckle board. The microstructure is a plurality of indentations in the surface of the deckle board. Preferably, the microstructure may be thousands of indentations or more, tens of thousands of indentations or more, hundreds of thousands of indentations or more, or even millions of indentations or more in the surface of a deckle board. The microstructure may be a plurality of recesses in the deckle board that some of the stock extends into so that turbulence is transmitted to the stock and the stock continues to move along the paper machine with the wire. The microstructure may be a repeating pattern, a striped pattern, an irregular pattern, a changing pattern based upon the distance from the head box, or a combination thereof. The microstructure may extend the entire length of the deckle board. The deckle board may be free of any smooth portions. The microstructure may have a shape formed into the surface of the deckle board that is round, dimples, through holes, a recess, square, octagonal, pentagonal, a nonagon, a polygon, or a combination thereof. For example, the microscope indentations may have a geometric shape such that the surface is not planar and upon contacting a fluid the fluid is moved by the microscopic indentations within the surface of the deckle board. The microstructure may be a three-dimensional indentation in the deckle board. The microstructure may be indentations in the stock side surface of the deckle board. The microstructure may be features on the face of the deckle board that prevent a buildup of stock. The microstructure may be concave, a recess, curve inward, or a combination thereof in to a surface of the deckle board. The deckle board may appear to be substantially planar to the naked eye. The deckle board may appear dimpled to the naked eye. The microstructure may only be visible under a microscope. The microstructure may be visible to the naked eye. The deckle board my "feel" substantially smooth to the touch. The deckle board may "feel" like sandpaper when touched. The microstructure may be in vertical rows (i.e., perpendicular to the machine direction), horizontal rows (i.e., along the machine direction), extend diagonally (i.e., in a vertical and horizontal direction), be entirely random, or a combination thereof. The microstructure may be convex, a projection, curve outward, or a combination thereof. The microstructure may be free of any linear segments. The microstructure may include a plurality of arc segments, curves, geometric figures, symmetrical shapes, or a combination thereof that create eddies in the stock. The microstructures may be located on an opposite side of the deckle board as the guide groove.

The one or more guide grooves may function to allow the deckle board to expand and contract. The one or more guide grooves may function to allow the one or more deckle boards to expand in the machine direction. The one or more guide grooves may retain the deckle boards within the wet end, the paper machine, or both. The one or more guide grooves may function to permit rotational movement of the deckle board. The one or more guide grooves may function to permit the deckle board to form a connection with a stand, a connection piece, or both at virtually any location. The one or more guide grooves may be located on a non-stock side of the deckle board, a top of the deckle board, or both. The one or more guide grooves may be any shape so that a connector piece is retained within the guide groove. The guide groove may be one solid piece. The guide groove may have one or more pieces that are connected with a fastener. The guide groove may be generally "T" shaped. The one or more guide grooves may include T-interruption grooves, T-slot grooves, or both. The guide grooves may include one or more T-slots and one or more T-interruptions. Preferably, the guide grooves include a plurality of T-slots and a plurality of T-interruptions. The guide groove may include one continuous T-slot. The guide groove may be free of T-interruptions. The T-slot may function to retain a connection device so that a fixed connection is formed. The T-slot may prevent the deckle board from being removed from a stand assembly, an adjustment bracket, or both. The T-slot portion may include a lip or flange that retains one or more components within the channel of the T-slot. The T-interruptions may be a recess in the guide grooves that permits removal from the stand assembly, the adjustment bracket, or both. The T-interruptions may be a gap in the T-slot where a lip or flange is not formed that extends over a recess, over a connection component, or both. The T-interruptions may function to allow the deckle board to be removed without having to slide the deckle board or connections with the deckle board the entire length of the wet end and/or deckle board. For example, if a deckle board is being replaced the locking portion of an adjustment device only needs to be moved from a T-slot to a T-interruption to remove the adjustment device from the deckle board. Preferably, the guide grooves include a plurality of T-slots and a plurality of T-interruptions, and more preferably the plurality of T-slots and the plurality of T-interruptions are alternating. The one or more guide grooves may include a plurality of through holes for forming a connection. The guide grooves may maintain the deckle board above the forming section, the wet end, the wire, the foil section, or a combination thereof. The guide grooves may maintain the deckle board above the wire so that the deckle board, the seal strip, or both function to create a deckled edge, eddies, or both. The guide grooves may function to create a quick connection, quick release, or both. The guide grooves, T-slot, or both may be located in other components of the deckle board.

The deckle board may function to create one or more edges of paper on the paper machine. The deckle board may form an edge of the paper machine in the cross-machine direction. The deckle board may substantially retain all of the stock (i.e., fiber, water, filler, and/or chemicals) within the wet end of the paper machine. The deckle board may create a straight edge. One or more of the deckle boards may extend in the machine direction. One or more of the deckle boards may extend outward at an angle relative to the machine direction. The one or more deckle boards may extend outward as the deckle boards extend in the machine direction such that the cross-machine direction gradually increases in the machine direction. The deckle boards on opposing sides of the paper machine may extend away from each other (i.e., diverge). The deckle boards may be linear, curved, stepped, linear segments with changing slopes, or a combination thereof. For example, the two deckle boards may extend outward so that the two deckle boards form a "V" shape. In another example, the deckle boards may extend outward and form generally two back to back "J" shapes. The deckle boards may be pliable so that the deckle boards generally curve as the deckle boards extend in the machine direction. A slope of the deckle boards may vary from vertical stand to vertical stand (e.g., from segment to segment). A slope of a first segment may be the same as a slope of a second segment. Downstream segments of the deckle board may increase in slope relative to the slope of the first segment, the second segment, or both. The first segment, the second segment, or both may have a slope that is substantially undefined (i.e., rise=a value and run=0) (e.g., a slope that is generally parallel to the machine direction (e.g., slope within about 0.5 or less, about 0.3 or less, or about 0.1 or less from an undefined slope). A slope of the first segment, the second segment or both may be indefinite (i.e., parallel to the machine direction), about 6000 or less, about 4000 or less, about 2000 or less, about 1000, or less, or about 100 or less. The second segment, third segment, fourth segment, fifth segment, a subsequent segment, or a combination thereof may have a slope of about 1000 or less, about 500 or less, about 100 or less, about 50 or less, or about 25 or less. The third segment, fourth segment, fifth segment, a subsequent segment, or a combination thereof may have a slope of about may have a slope of about 500 or less, about 100 or less, about 50 or less, about 25 or less, about 10 or less. The fourth segment, fifth segment, a subsequent segment, or a combination thereof may have a slope of about may have a slope of about 100 or less, about 50 or less, about 25 or less, about 10 or less, about 5 or less, about 3 or less. The slope from segment to segment may vary buy about 100 or less, about 50 or less, about 25 or less, or even about 10 or less. A change in slope may increase as the deckle board extends in the machine direction. For example, the amount the deckle board curves outwards may increase as the deckle board extends in the machine direction, thus increasing the rate of change of the slope. For example, a change in slope between the second segment and the third segment may be about 3 and the change in slope between the third segment and the fourth segment may be about 15. The slope may vary within a segment. The slope at a beginning of a segment to an end of a segment may vary by about 100 or less, about 50 or less, about 25 or less, or about 10 or less. The slope may vary within a segment. The slope at a beginning of a segment to an end of a segment may vary by about 0.1 or more, about 0.5 or more, about 1 or more, or about 5 or more. Preferably, the deckle board curves in the machine direction as the deckle board extends away from the head box so that the deckle board has an exponential curve (i.e., the curve of the deckle board increases at a greater rate as the deckle board extends away from the head box). The slopes of the segments may become larger as the segments extend away from the headbox, thus, the first segment may be less than all subsequent segments, the second segment may be the same as or greater than the first segment, the third segment may be the same as or greater than the first segment and the second segment, and so on. The deckle board may include a deckle board clamp, a seal clamp, a plurality of fasteners, one or more seal strips, one or more covers, one or more head box attachments, one or more fastener baskets, or a combination thereof. Preferably, the deckle board includes a deckle board clamp and a seal strip clamp that hold a seal strip in place and the deckle board clamp and the seal strip clamp are connected together by a plurality of fasteners. The deckle board clamp and the seal clamp may apply a force on the seal strip that retains the seal strip within the deckle board. The deckle board may include a single fastener that retains the seal strip within the deckle board. Preferably, the deckle board may include a connection fastener that prevents longitudinal movement of the seal strip (i.e., movement in the machine direction). The deckle board may include a plurality of pressure fasteners along the length of the deckle board that retains the seal strip between the deckle board clamp and the seal strip clamp.

The deckle board clamp may function as a gripping feature to retain a seal strip within the deckle board. The deckle board clamp may function to permit longitudinal movement of the seal strip relative to the deckle board due to thermal expansion or vice versa. The deckle board clamp may resist lateral movement of the seal strip (i.e., down towards the wire, forming section, and/or paper machine). The deckle board clamp may be a portion of the deckle board on the non-stock side that forms one wall of a pinch point that retains the seal strip within the deckle board. The deckle board clamp may be integrally connected to a seal strip clamp. The deckle board clamp and seal strip clamp may be connected together one or more and preferably a plurality of fasteners.

The seal strip clamp may function as a gripping feature to retain a seal strip within a deckle board. The seal strip clamp may function to permit longitudinal movement of the seal strip relative to the deckle board due to thermal expansion or vice versa. The seal strip clamp may resist lateral movement of the seal strip (i.e., down towards the wire, forming section, and/or paper machine). The seal strip clamp may be a discrete piece that is connected to the deckle board, the deckle board clamp, or both. The seal strip clamp may be a wall that opposes the deckle board clamp and retains a seal strip within the deckle board. The seal strip clamp may be a solid piece. The seal strip clamp may be a hollow piece. The seal strip clamp may include one or more internal pockets, one or more fastener baskets, or both. The one or more fastener baskets may connect to the deckle board, a fastener, or both and retain all or a portion of the fastener within the deckle board system. The one or more fastener baskets may function to prevent fastener pieces from falling into the paper machine. The one or more fastener baskets may perform one or more of the functions of the internal pockets. The internal pockets may be a recess, an absence of material, an opens space, or a combination thereof. The internal pockets may house one or more fasteners. The internal pockets may house a plurality of fasteners. The internal pockets may prevent debris, fluid, stock, fiber, filler, chemicals, or a combination thereof from contacting all or a portion of the fasteners. The internal pocket may prevent all or a portion of the fasteners if they become loose from falling into the paper machine, the wet end, on the wire, or a combination thereof. The internal pocket may retain a nut, a washer, a threaded member, a lock washer, or a combination thereof to maintain them in a clean environment and prevent loss of these pieces. The seal strip clamp may include one or more guide grooves, T-slots, or both so that one or more covers may be removed and the fasteners accessed. The one or more guide grooves may allow a cover to be snapped in place, slid in place, partially snapped in place and partially slid in place, or a combination thereof.

The one or more covers may function to block one portion of an internal pocket. The one or more covers may function to be a removable piece so that an internal pocket may be accessed. The one or more covers may be a solid piece that prevents debris, water, stock, chemicals, filler, fines, or a combination thereof from entering the internal pocket. The one or more covers may assist in enclosing the internal pocket so that all of the components within the internal pocket are retained within the internal pocket. The internal pocket and cover may house a plurality of fasteners, one or more connection fasteners, a plurality of pressure fasteners, or a combination thereof so that the seal strip clamp, the seal strip, or both are connected to the deckle board clamp.

The seal strip may function to form a seal between the deckle board and the wire. The seal strip may be made of any material that may form a seal with the wire, the foils, or both. The seal strip may function to create a low surface energy material barrier. The seal strip may function to prevent stock build up, prevent laminar flow, or both. The seal strip may be compliant so that the seal strip moves with angle adjustable foil blades, height adjustable foil blades, or both and prevents stock from passing under the seal strip. The seal strip may move with the foils as the foils are adjusted so that stock is retained on the wire. The seal strip may be a low friction material. The seal strip may be made of polytetrafluoroethylene, coated with polytetrafluoroethylene, include polytetrafluoroethylene, or a combination thereof. The seal strip may include a plurality of slots. The plurality of slots may function to connect the seal strip within the deckle board. The plurality of slots may function to allow for expansion, contraction, or both of the seal strip. The plurality of slots may include one or more connection slots and one or more expansion slots.

The connection slots function to prevent the seal strip from being removed from the deckle board, entirely moved in the machine direction, or both. The connection slot may allow for a fastener to extend through the seal strip. Preferably, the seal strip includes at least one connection slot for preventing movement of the seal strip in the machine direction; preventing the seal strip from being pulled by the wire, stock, or both. However, the seal strip may include a plurality of connection slots. More preferably, the single connection slot is the slot located closest to the head box. The connection slots may be round, oval, a slit, a through hole, or a combination thereof. The seal strip may include a plurality of expansion slots that are located adjacent to the connection slots and in a successive row.

The plurality of expansion slots may allow the seal strip, the deckle board, or both to thermally expand and contract relative to each other so that the seal strip retains its planar shape, is free of waves, is free of wrinkles, or a combination thereof. The plurality of expansion slots may allow for thermal expansion and contraction of the deckle board and seal strip at different rates so that the seal strip is free of contact with the fasteners and is not warped. The plurality of expansion slots may allow for the seal strip to move in the machine direction and be free of contact with a fastener, be free of resistance from a fastener, or both. The one or more expansion slots may be an absence of material on the upstream side, the downstream side, or both of each fastener so that the seal strip is free to move in the machine direction. The expansion slots may be sufficiently large so that upon maximum thermal expansion and/or thermal contraction of the deckle board and seal strip relative to each other the walls of the expansion slots do not contact the fasteners. The expansion slots may be open. The expansion slots may have one or more walls that extend to a terminal edge so that a gap is created between an adjacent wall. The expansion slots may be generally "U" shaped. The expansion slots may allow for removal and/or replacement of the seal strip without removal of all of the fasteners. For example, only the connection fastener may need to be completely removed to remove the seal strip and add a new seal strip installed in the deckle board and the pressure fasteners may only need to be loosened. Thus, in another example, upon removal of the connection fastener and loosening of the pressure fasteners the seal strip may be pulled out from between the deckle board clamp and the seal strip clamp and a new seal strip installed. The seal strip may be a plurality of individual pieces that may be connected together to form one continuous piece. The seal strip may extend the entire length of the forming section (i.e., from the breast roll and/or head box to the couch roll). The seal strip may be retained within the deckle board by one or more fasteners.

The fasteners may function to connect the one or more seal strips within the deckle board, to the deckle board, or both. The one or more fasteners may extend through the seal strip, create pressure on the seal strip, or both. Preferably, only one fastener extends through the seal strip (i.e., a connection fastener). The connection fastener preferably is the first fastener, is located proximate to the head box, or both although the connection fastener may be located downstream of the head box (e.g., in a second or third slot). The one or more and preferably a plurality of fasteners (i.e., pressure fasteners) may create pressure on the seal strip. The plurality of fasteners may be a plurality of pressure fasteners that create a clamping force on the seal strip to retain the seal strip proximate to the deckle board. The plurality of fasteners may connect the deckle board clamp and the seal strip clamp together. The plurality of fasteners may connect the deckle board to the head box.

The deckle board system may include a head box attachment that attaches the deckle board system to a location proximate to the head box, to the head box, the breast roll arm, or a combination thereof. The head box attachment may be a single point of fixed attachment (i.e., is not movable). The head box attachment may create an anchor that prevents the deckle board system from moving in the machine direction, although the deckle board system may be extendable and/or expandable in the machine direction. The head box attachment may attach to one or more shower systems or may connect the deckle board and the one or more shower systems to the paper machine.

The one or more shower systems may function to clean the deckle board system. The one or more shower systems may function to prevent a buildup of stock on any deckle board components. The shower system may function to create a boundary layer. The shower system may function to prevent stock build-up on any parts of the deckle board system. The shower system may create a continuous waterfall of water on the stock side, non-stock side, or both of the deckle board. The shower system may cascade water over the top of the deckle board to clean the deckle board, create the boundary layer, or both. The shower system may provide water equally to the stock side and non-stock side of the deckle board. The shower system may provide water along the deckle board in the machine direction. For example, the shower system may spray water in the machine direction so that the water forms a fluid barrier between the stock and the deckle board. The shower system may spray water in the machine direction so that a velocity difference between the stock and the fluid boundary layer is minimized so that the fluid boundary layer prevents waves, disruptions, or both on the edges of the stock. The shower system may include one or more shower bars, one or more shower nozzles, or both that apply a spray to the deckle board. The one or more shower systems may be two or more, three or more, or even four or more sets of shower systems. The one or more shower systems may be an upper shower system, a lower shower system, an end shower system, a boundary layer shower system, or a combination thereof.

The upper shower system may function to create a constant waterfall of water across the deckle board, a curtain of water, or both on the one or both sides of the deckle board. The upper shower curtain may provide water on the top of the deckle board so that water flows on both sides. The upper shower curtain may gravity feed water to the top of the deckle board. The upper shower may spray water on the top of the deckle board with a pressure of about 35 kPa or more, about 70 kPa or more, about 105 kPa or more, or even about 140 kPa or more. The upper shower may spray water on the top of the deckle board with a pressure of about 500 kPa or less, about 400 kPa or less, about 300 kPa or less, or even about 200 kPa or less. The upper shower may provide a sufficient amount of water so that a boundary layer is provided between the deckle board and the moving stock. The amount of water may vary based upon the speed of the wire. For example, if the wire is moving 100 m/min each nozzle may apply 2 L/min and if the wire is moving 200 m/min each nozzle may apply 4 L/min. The amount of water applied to the deckle board may be any amount of water discussed herein. The upper shower may provide spray, water, or both behind a boundary layer system. The water may be applied in such a manner that surface tension of the water applied may maintain the water proximate to the deckle board, the seal strip, or both. The upper shower system may be used alone or in conjunction with a lower shower system.

The lower shower system may be located entirely on the non-stock side of the deckle board. The lower shower system may function to direct fluid at the seal strip, under the seal strip, or both. The lower shower system may create turbulence at the seal strip, on the seal strip, or both. The lower shower system may provide a boundary layer of water at the seal strip, under the seal strip, in front of the seal strip, or a combination thereof. The lower shower system may prevent a seal from being formed between the seal strip and the wire, forming table, foils, or a combination thereof. The lower shower system may have a low angle trajectory. The lower shower system may be angled so that any waves on the wire, forming table, or both are negated by the spray of the lower shower system. The lower shower system may dampen any waves on the wire, forming table, or both. The lower shower system may direct water at an angle of about 2 degrees or more, about 5 degrees or more, about 7 degrees or more, about 10 degrees or more or even about 15 degrees or more from horizontal to a location proximate to the seal strip. The lower shower system may direct water at an angle of about 45 degrees or less, about 30 degrees or less, or about 20 degrees or less from horizontal (e.g., a plane of the wire surface) to a location proximate to the seal strip. The lower shower may spray water at the non-stock side of the deckle board, at the seal strip, or both with a pressure of about 35 kPa or more, about 70 kPa or more, about 105 kPa or more, or even about 140 kPa or more. The lower shower may spray water at the non-stock side of the deckle board, the seal strip, or both with a pressure of about 500 kPa or less, about 400 kPa or less, about 300 kPa or less, or even about 200 kPa or less. The upper shower system and the lower shower system may span all or a portion of the length of the wet end, the forming table, the wire, or a combination thereof. The upper shower system and the lower shower system may mirror each other. For example, the nozzles of the upper shower system may be longitudinally located at a same distance as the nozzles of the lower shower system. The nozzles of the upper shower system and the nozzles of the lower shower system may be staggered, aligned, or both. The upper shower system, lower shower system, or both may be used in conjunction with and/or replaced by one or more end showers.

The one or more end showers may function to provide water to the head box end of the deckle board, the breast roll end of the deckle board, or both. The one or more end showers may function to provide additional water to the ends of the deckle board. The one or more end showers may provide additional cleaning to the ends of the deckle boards. The one or more end showers may only be located at the head box end and may create turbulence at the beginning of the deckle board. The one or more end showers may spray directly on the face of the deckle board. The one or more end showers may double the amount of water added to the deckle board at discrete locations. The end shower may deliver a similar amount of fluid at a similar pressure to what is described herein for the upper shower system and lower shower system, the teachings of which are incorporated herein. The one or more end showers may include a shower bar that extends outward away from the deckle board and then curves back towards the deckle board. The end shower may be located above and/or adjacent to a boundary layer shower.

The boundary layer shower may function to form a boundary layer of fluid (herein after water, but the water may include paper machine chemicals, fines, be recycled paper machine water, or a combination thereof) between the stock and the face of the deckle board. The boundary layer shower may function to hydraulically form a deckled edge. The boundary layer shower may form current, eddies, turbulence, or a combination thereof along an edge of the deckle board so that a deckled edge is formed. The boundary layer shower may provide water at a sufficient velocity so that shear between the boundary layer water and the stock is minimized, reduced, and/or eliminated. For example, the boundary layer water may be sprayed in the machine direction so that the boundary layer water does not create a high amount of drag on the stock so that build up is formed. The boundary layer shower may function to provide water that forms a boundary layer at substantially the same speed as the stock is moving. The boundary layer fluid may be sprayed at a speed within about 200 m/s or less, about 150 m/s or less, or even about 100 m/s or less of the machine speed. Thus, for example, if the machine speed is about 1000 m/s the speed of the fluid directed from the boundary layer shower may be about 900 m/s or less. The boundary layer water may lubricate the face of the deckle board so that stock is prevented from collecting and so that thickness, caliper, density, basis weight, or a combination thereof are not affected at the dry end. The boundary layer shower may function to keep stock moving in the machine direction, prevent laminar flow from forming proximate to the seal strip, the deckle board, or both. The boundary layer shower may eliminate waves in the stock, on the forming section, on the wire, at the edges, or a combination thereof. The water from the boundary layer showers may run down the face of the deckle board and in the machine direction so that upon contact with stock waves are dampened, dissipated, eliminated, reduced, or a combination thereof. The boundary layer water may prevent waves from extending from the edge back towards the center. For example, any waves that are generated may be eliminated upon contact with the boundary layer water from the boundary layer shower. The boundary layer shower may provide water that clears the face of the deckle board, the seal strip, or both so that stock is exposed to a uniform surface along the machine direction. The boundary layer shower may provide spray against the machine direction (i.e., in an opposite direction as the stock is moving). The boundary layer shower may provide spray in the machine direction so that the stock and the deckle board are free of contact, do not contact each other, or both. The boundary layer shower may provide water at an angle of about 5 degrees or more, about 10 degrees or more, about 15 degrees or more, about 25 degrees or more, or even about 40 degrees or more from vertical. The boundary layer shower may provide water at an angle of about 90 degrees or less, 75 degrees or less, about 60 degrees or less, or even about 45 degrees or less from vertical. The boundary layer shower may have a fan configuration so that a portion of the spray extends vertically and a portion of the spray extends at an angle of about 90 degrees from vertical. The spray may extend out of the shower nozzles at an angle. The angle of the spray extending out of the shower nozzles may be about 5 degrees or more, about 10 degrees or more, about 15 degrees or more, about 25 degrees or more, or even about 30 degrees or more. The angle of the spray extending out of the nozzles may be about 90 degrees or less, about 75 degrees or less, or even about 60 degrees or less. The end shower, the boundary layer shower, the upper shower system, and the lower shower system all include one or more shower bars, one or more nozzles, and one or more holders.

The one or more shower bars function to provide fluid to a predetermined location. The one or more shower bars even distribute fluid across one or more and preferably a plurality of nozzles. The one or more shower bars may function to aim the spray. The one or more shower bars may function to provide fluid to a hard to reach location. The one or more shower bars may function to be movable to a desired location. The one or more shower bars may function to be static. Each of the shower systems may include one or more shower bars and preferably a plurality of shower bars. The one or more shower bars may directly receive one or more nozzles and preferably a plurality of nozzles.

The one or more nozzles may function to regulate fluid flow. The one or more nozzles may function to direct fluid to a location. The one or more nozzles may regulate the pressure of the fluid. The one or more nozzles may regulate the shape of the fluid spray. Preferably, the fluid spray is a flat fan spray. The nozzles may function to regulate the amount of fluid delivered per minute to be any of the rates listed herein for each location. Each nozzle may deliver about 0.5 L/min or more, about 1 L/min or more, about 2 L/min or more, about 3 L/min or more, or even about 5 L/min or more. Each nozzle may deliver about 50 L/min or less, about 40 L/min or less, or about 30 L/min or less. Each of the nozzles may be directed to a predetermined location by connecting the shower system into a holder.

The one or more shower systems may include one or more holders that connect the one or more shower bars to the one or more deckle boards, the stand assemblies, or both The one or more holders may extend from the non-stock side of the deckle board, above the deckle boards, or both. The one or more holder assemblies may maintain the shower bars in an elevated position, at an angle, or both. The one or more holder assemblies may allow for rotation of the shower systems. The one or more holder assemblies may allow for longitudinal movement, lateral movement, or both of the shower systems. The one or more holders may connect to a stand assembly, (e.g., a vertical stand, a horizontal stand, or both) of the deckle board system.

The deckle board system may include one or more stand assemblies. The one or more stand assemblies may function to connect the deckle board, the shower systems, or both within the deckle board assembly. The stand assemblies may connect the deckle board, the shower systems, the deckle board assembly, or a combination thereof to the paper machine. The one or more stand assemblies may function to align the deckle board with the wire, forming section, paper machine, or a combination thereof. The one or more stand assemblies may include a horizontal stand, a vertical stand, or preferably both. The one or more stand assemblies may be height adjustable, horizontally adjustable, angle adjustable, or a combination thereof. Preferably, each stand assembly includes a vertical stand and a horizontal stand that are connected together.

The one or more vertical stands may connect the deckle board system to the frame of the paper machine (i.e., main frame, breast roll arm, or both). The one or more vertical stands may function to adjust the deckle board so that the deckle board, the seal strip, or both are above the wire, in contact with the wire, free of contact with the wire, at a desired location, or a combination thereof. The one or more vertical stands may function to accommodate adjustments to the foils so that a deckled edge is maintained. The one or more vertical stands may be static in the machine direction so that once the vertical stands are connected to the paper machine the vertical stands do not move relative to the paper machine. The one or more vertical stands may side within a track that is connected to the paper machine so that the vertical stands may be moved inward or outward relative to the wire, forming section, stock, or a combination thereof. The one or more vertical stands may rotate in the cross-machine direction and against the cross-machine direction along the machine direction. The one or more vertical stands may be rotated by the deckle boards expanding and contracting. The deckle board may be connected directly to a vertical stand. The one or more vertical stands may be connected to one or more horizontal stands.

The one or more horizontal stands may function to extend over the forming section, the wire, the foils, the wet end, or a combination thereof. The one or more horizontal stands may vary the cross-machine width of the paper machine by the length of the horizontal stand being adjusted. The one or more horizontal stands may function to change the cross-machine width of the paper machine in the machine direction as the stock flows in the machine direction. For example a distance the horizontal stands extend over the paper machine may decrease in the machine direction as the stock flows away from the headbox so that the cross-machine length increases. The one or more horizontal stands may be adjusted so that the one or more deckle boards on a first side are straight and the one or more deckle boards on the opposing side diverge away from the deckle boards on the first side. The horizontal stands may adjust the one or more deckle boards on a first side and a second side so that both the deckle boards on the first side and the deckle boards on the second side diverge away from each other. The horizontal stands may move each of the deckle boards so that the deckle boards extend outward (i.e., increase the cross-machine width) in a linear shape, curved shape, a constant curve, an exponential curve, or a combination thereof. A segment between two of the stand assemblies may be generally linear. A segment between two stand assemblies may have a different slope as a segment between two adjacent stand assemblies (i.e., upstream or downstream in the machine direction). The horizontal stand may be moved to accommodate thermal contraction and/or thermal expansion of the deckle board. The horizontal stand may be angled upward (away from the wire), downward (towards the wire), or both. The one or more horizontal stands, one or more vertical stands, or both may include an inner tube and an outer tube, a lift plate, a movement member, an adjustment device, or a combination thereof.

The inner tube and outer tube may be movable relative to each other to adjust a length of the stands (e.g. height). The one or more outer tubes may function to allow the deckle boards to expand and contract. The one or more outer tubes may rotate. The one or more outer tubes and/or inner tubes may vertically move up and down. The one or more outer tubes and/or inner tubes may horizontally move in and out. The one or more outer tubes may be held in the system by gravity. The one or more outer tubes may rotate about an inner tube. The outer tube may have an open area that receives the inner tube. The outer tube may be hollow. The one or more outer tubes may be free of a fixed connection with the inner tube.

The inner tube may function to connect the deckle board system to the paper machine. The inner tube may function to move while the outer tube remains static. The inner tube may be static. The inner tube may form a bearing surface for the outer tube to rotate about or vice versa. The inner tube may provide a stationary part for the outer tube to be moved about. The inner tube may be solid, hollow, or a portion of both. The inner tube may include and/or be connected to a lift plate.

A lift plate may function to provide a surface for a member to press against to move a portion of a stand. A lift plate may function to allow a member to contact so that the outer tube is moved relative to the inner tube. The lift plate may be part of the inner tube that a movement member presses against to move the outer tube, the deckle board system, or both. The lift plate may be a solid piece. The lift plate may include a through hole. The lift plate may be threaded. The lift plate may be fixedly connected to a movement member.

The movement member may axially move the horizontal stand, the vertical stand, or both. The movement member may function to move an outer tube relative to an inner tube. The movement member may function to lift, extend, or both the stands. The movement member may extend cantilever from the lit plate. The movement member may be threaded. The movement member may push the outer tube to extend the stand and pull the outer tube to shorten the outer stand. The movement member may be an electric telescoping arm. The movement member may be an arm that is axially extended by a servo motor. The movement member may be threaded member. The threaded member may be located within the vertical stand, the horizontal stand, or both.

The one or more horizontal stand may extend cantilever and support the deckle board, the shower system, or both. The horizontal stand may extend the deckle boards over the wire. The horizontal stand may determine the width of the wet end. The horizontal stand may be connected to the vertical stand by one or more brackets. The horizontal tube, the vertical stand or both may be adjusted by an adjustment device.

The adjustment device may function to vary the length, height, or both of the vertical stand, the horizontal stand, or both. The adjustment device may be manual, automated, motorized, electrical, hydraulic, or a combination thereof. The adjustment device may be a motor, a crank, a knob, or a combination thereof. The adjustment device may change the vertical stand, the horizontal stand, or both by controlling the movement member. For example, the adjustment device may be a hand crank and the movement member may be threaded and rotation of the hand crank may move the movement member so that the vertical stand and/or horizontal stand is adjusted. The horizontal stand, the upper stand, or both may include rotation device.

The rotation device may function to vary the angle of the deckle board relative to vertical, the wire, the wet end, or a combination thereof. The rotation device may move the seal strip in the cross-machine direction. The rotation device may include a lower bracket clamp, an upper bracket clamp, a clamping structure, or a combination thereof. The rotation device may be located opposite the adjustment device. The rotation device may rotate about an axis while all of the other components remain static except for the deckle board. The rotation device and the deckle board may rotate and the lower bracket clamp, upper bracket clamp, or both may remain static.

The lower bracket clamp and the upper bracket clamp may combine together to prevent rotational movement of the rotation device. The lower bracket clamp and the upper bracket clamp may allow for rotational movement of an adjustment bracket while supporting the adjustment bracket. The lower bracket clamp and the upper bracket clamp when tightened prevent movement of the adjustment bracket and when loosened allow for movement of the adjustment bracket. The lower bracket clamp and the upper bracket clamp may be opposing arms that create a clamping force. The lower bracket clamp and the upper bracket clamp may create a clamping force by being connected by a fastener. The lower bracket clamp, upper bracket clamp, clamping structure, or a combination thereof, may function to retain a T-nut, a slidable member, or both at the end of the horizontal stand so that the T-nut, slidable member, or both may be rotationally movable. The lower bracket clamp, the upper bracket clamp, clamping structure, or a combination thereof may connect to an adjustment bracket, clamp an adjustment bracket, or both.

The adjustment bracket may function to connect to a stand (e.g., horizontal stand) and connect to a T-nut, a slidable member, or both. The adjustment bracket may be connected to a stand assembly on one side and a guide groove on a second side. The adjustment bracket may allow be rotatable so that an angle of the deckle board may be varied relative to the wire, the wet end, or both. The adjustment bracket may function to adjust the deckle board as is discussed herein regarding the deckle board angle. The adjustment bracket may be translated in 5 degrees (e.g., up, down, left, right, rotate about a longitudinal axis, rotate about a lateral axis, or a combination thereof). The adjustment bracket may be sandwiched between the upper bracket clamp, the lower bracket clamp, or both. The adjustment bracket may extend into a guide groove or may receive the guide groove. The adjustment bracket may be substantially cylindrical. The adjustment bracket may include one or more slots. The adjustment bracket may be free of slots. The adjustment bracket may allow the T-nut, the slidable member, or both to move within the guide groove when the deckle board expands and contracts.

The T-nut, the slidable member, or both may fit within a guide groove and connect the deckle board to a stand. The T-nut, the slidable member, or both may slide within the guide groove so that the deckle board is movable in the machine direction, expandable, contractible, or a combination thereof. The T-nut, the slidable member, or both may be removable through a T-interruption. The T-nut may have a portion that is generally "T" shaped. The T-nut may have outwardly extending wing portions.

The vertical stand, the inner tube, or both may include a stand bracket, be connected to a stand bracket, or both. The vertical stand, the inner tube, the outer tube, or both may be fixedly connected to a stand bracket. The stand bracket may fit within and/or connect to a connection stand that is connected to the paper machine, a frame, or both. The stand bracket may extend over and receive the connection stand. The connection stand may receive the stand bracket. The connection stand, the stand bracket, or both may include one or more angled brackets. The one or more angled brackets may extend from the stand bracket to the connection stand so that lateral movement, longitudinal movement, or both is prevented. The angled brackets may provide one or more fastening locations so that the stand bracket and connection stand may be connected. The angled bracket may be general "L" shaped. The angled bracket may receive a portion of the connection stand. The stand bracket may include a plate that is connected to the inner tube, the outer tube, or both and the angled brackets may be connected to the plate.

Additional aspects of the deckle board system can be gleaned from the teachings herein including those of the deckle board system, shower system, shower bars, holders, guide grooves, and deckle boards of the deckle board system, shower system shower bars, stand assembly, holders, guide grooves, and deckle boards shown in FIGS. 1-39 and discussed in paragraphs 0049-0063, and specifically FIGS. 12, 14, 17, 19, 20, 24-25, and 28-29 of U.S. Provisional Patent Application No. 61/939,477 filed on Feb. 13, 2014 and 61/939,793, filed on Feb. 14, 2014 the teachings of which are incorporated by reference herein in their entirety for all purposes. Additional aspects of the deckle board system, shower system, stand assembly, deckle board, or a combination thereof as found in claims 1-42 of U.S. Provisional Patent Application No. 61/939,477 filed on Feb. 13, 2014 and 61/939,793, filed on Feb. 14, 2014 the teachings of which are incorporated by reference herein in their entirety for all purposes.

The deckle board system may be adjusted via a method. The method may include moving the vertical stands, the horizontal stands, or both so that the deckle board expands a width of the paper machine. The deckle board may be curved. The deckle board may be adjusted segment by segment. The deckle board may be added to stand assemblies that are pre-set. The deckle board stands may be moved so that the horizontal stands are out of alignment.

FIG. 1 illustrates a perspective view of a paper machine 2. The paper machine 2 includes a wire (not shown) that extends along a machine direction 120 and has a width along the cross machine direction 122. At a beginning of the paper machine 2 is a head box 4 that is located above a breast roll 6 and places stock in the wet end 10 of the paper machine 2. The wet end 10 includes a plurality of foil sections 12 that each include a plurality of foils 14. The wet end 10 has a deckle board system 30 that as shown extends along one side of the wet end 10 (however a typical paper machine includes a deckle board system on both sides).

Figure 2:
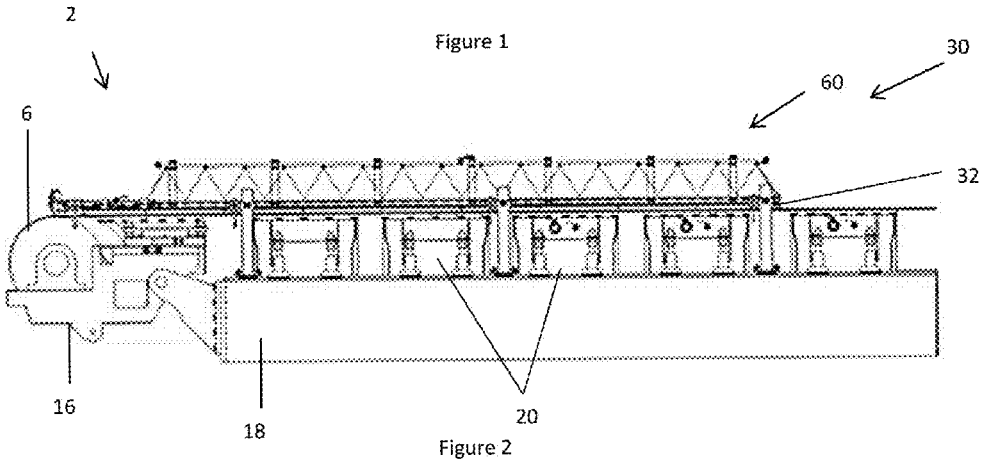
FIG. 2 illustrates a side view of a deckle system on a paper machine.

FIG. 2 illustrates a side view of the paper machine 2 with the head box removed. A breast roll 6 is shown at a first end and is in communication with a breast roll arm 16. A main frame 18 is in communication with the breast roll arm 16 and the deckle board system 30. The deckle board system includes a deckle board 32 and a shower system 60.

Figure 3:
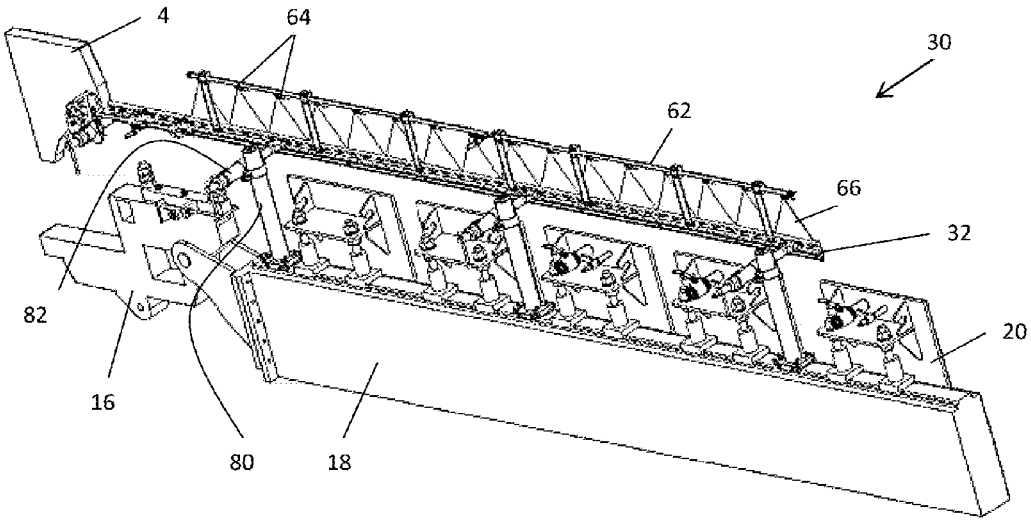
FIG. 3 illustrates a perspective view of a deckle system connected to a frame.

FIG. 3 illustrates a perspective view of the deckle board system 30 with the wet end removed except for the connection portions of the wet end. The deckle board system 30 is connected to the head box 4 at one end. A shower bar 62 extends along a length of the deckle board system 30 and includes a plurality of spray nozzles 64 that each generate a spray 66. The deckle board system extends above a plurality of end plates 20 and is connected to the main frame 18 and the breast roll arm 16 by a plurality of vertical stands 80 and a plurality of horizontal stands 82.

Figure 4A:
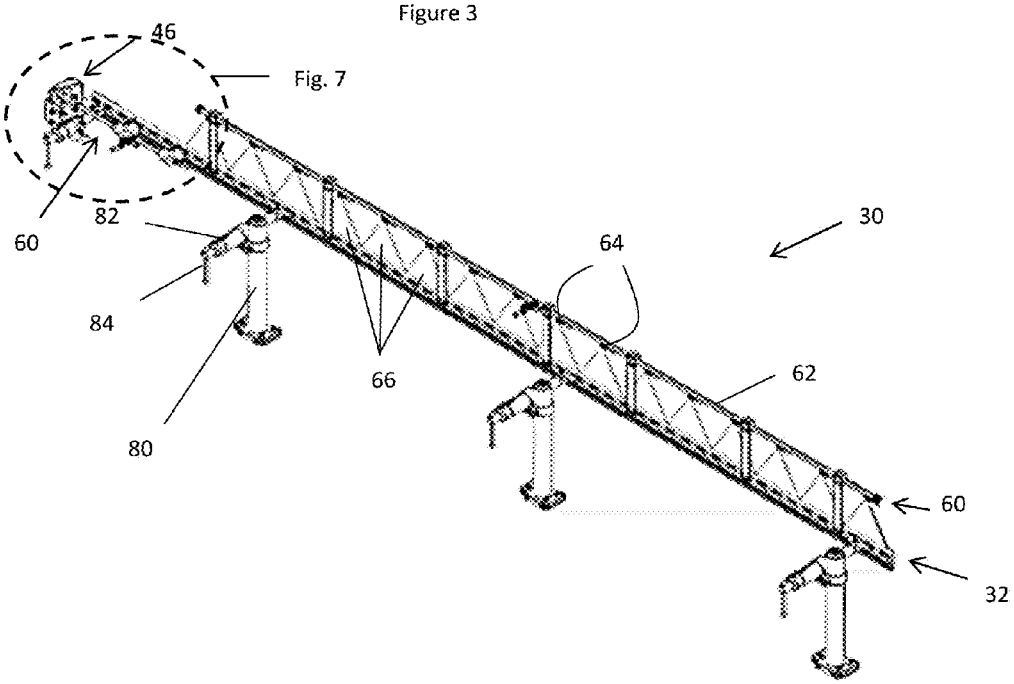
FIG. 4A illustrates a top perspective view of a deckle system.

FIG. 4A illustrates a perspective view of the deckle board system 30 removed from the connection portions. The deckle board system 30 includes a plurality of vertical stands 80 that are in communication with a plurality of horizontal stands 82 and adjustment devices 84 that adjust the deckle board system. The horizontal stands 82 and vertical stands 80 are connected together forming a stand and the stands including the deckle board system 30 may be slid onto and off of a paper machine. The deckle board 32 extends between the plurality of stands and includes a shower system 60 proximate to the deckle board 32. One shower system 60 is located proximate to a head box attachment 46 that connects to the head box or a region proximate to the head box and a second shower system 60 extends down steam of the shower system 60 proximate to the head box. Both shower systems 60 include a shower bar 62 with a plurality of nozzles 64 for each creating a spray 66.

Figure 4B:
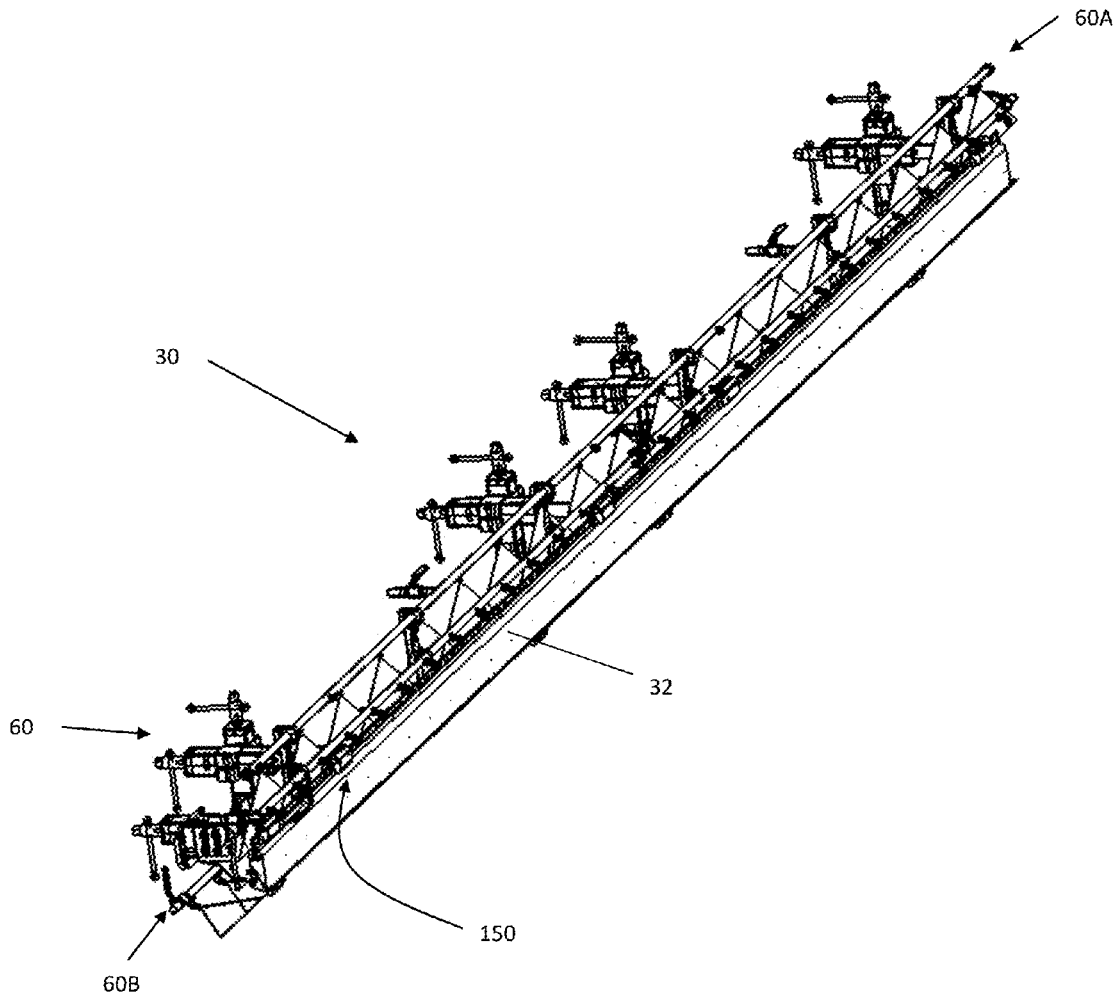
FIG. 4B illustrates a top perspective view of a face of a deckle board system.

FIG. 4B illustrates a deckle board system 30 including a deckle board 32 and three separate shower system 60. The shower system 60 includes an upper shower system 60A that directs water on the top of the deckle board 32, a lower shower system 60B that directs water to the non-stock side of the deckle board 32, and a boundary layer shower 150 that directs water across the face of the deckle board 32. The boundary layer shower system 150 creates a boundary layer of water between the deckle board and the stock on the paper machine so that a consistent deckled edge is created.

Figure 5:
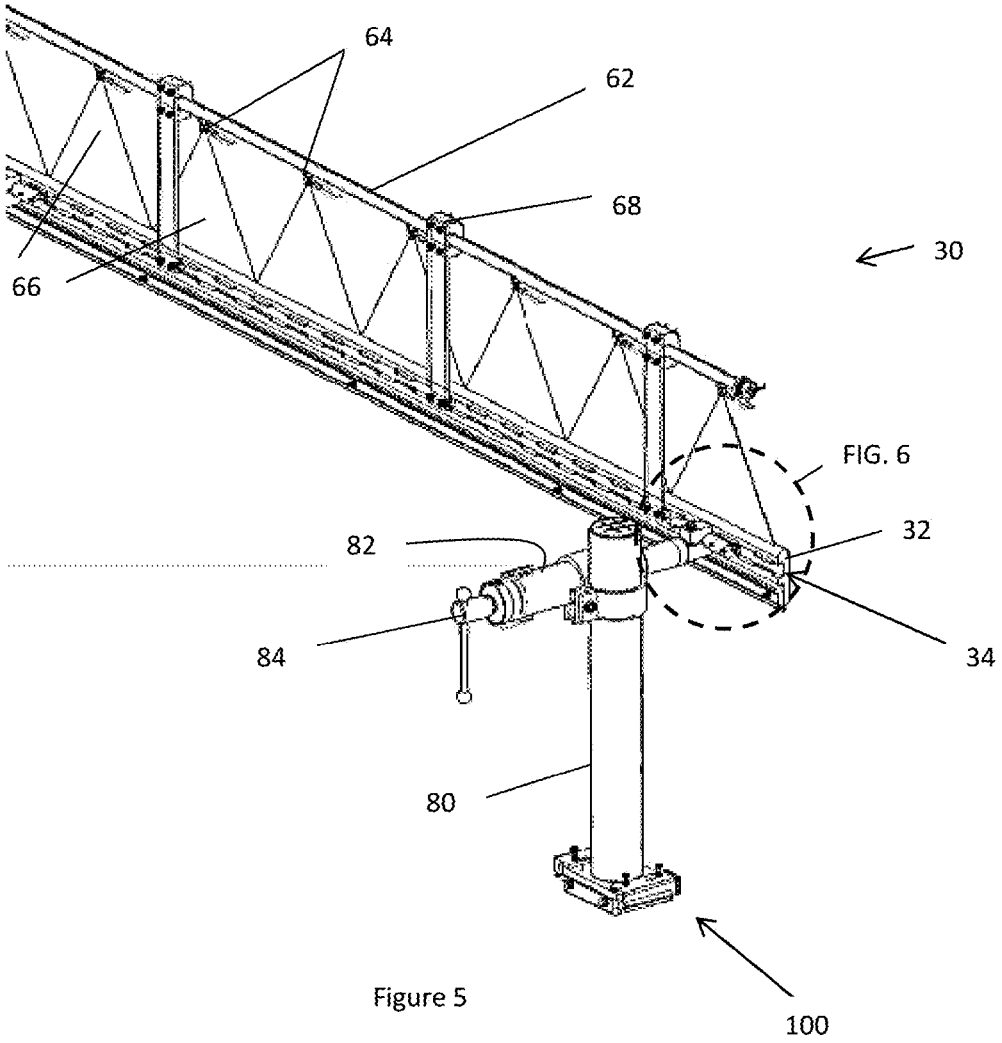
FIG. 5 illustrates a close-up view of an end of a deckle system.

FIG. 5 illustrates a perspective view of an end of a deckle board system 30. A connection stand 100 connects to a vertical stand 80, which is in communication with a horizontal stand 82 and an adjustment device 84. The connection stand 100 allows the deckle board system 30 to be slid on and off the paper machine (not shown). The horizontal stand 82 is in communication with a guide groove 34 extending along the deckle board 32. A plurality of holders 68 connect a shower bar 62 above the deckle board 32. The shower bar 62 includes a plurality of shower nozzles 64 that create a spray 66.

Figure 6:
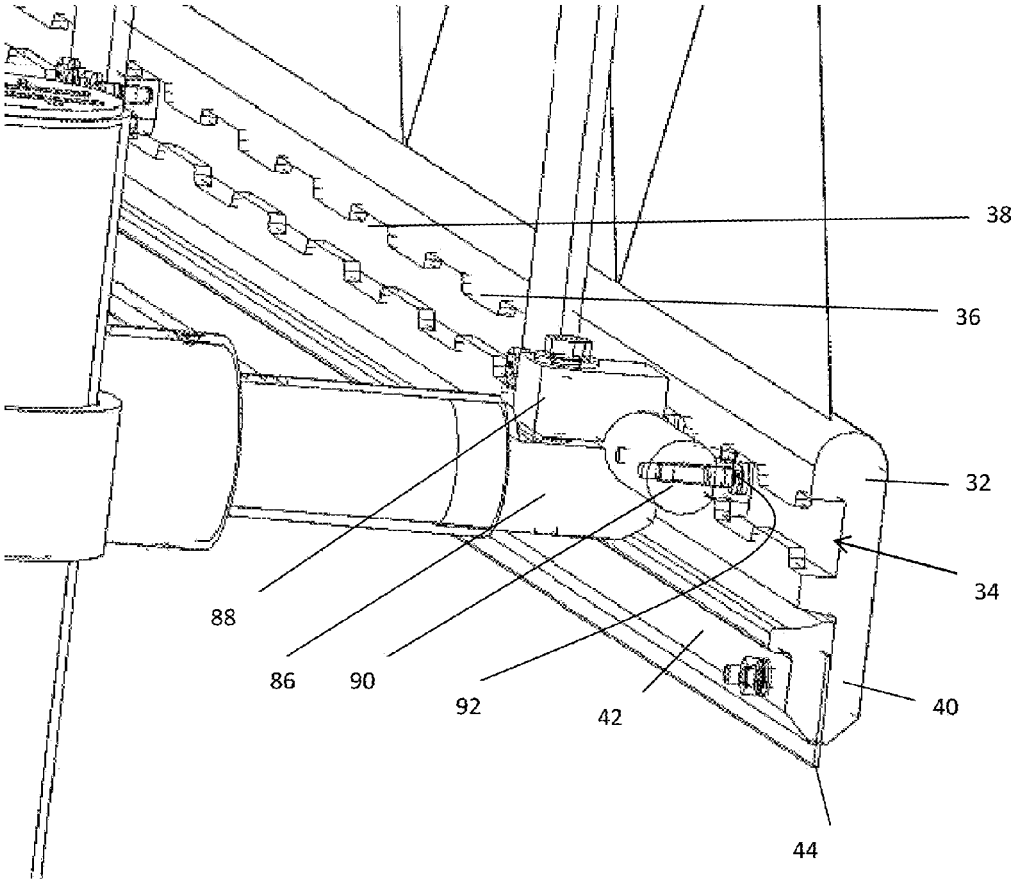
FIG. 6 illustrates a close-up view of the end of the deckle board of FIG. 5.

FIG. 6 illustrates a close-up view of the end of the deckle board 32 of FIG. 5. The deckle board 32 includes a guide groove 34 that extends the length of the deckle board 32. The guide groove 34 includes a plurality of T-slots 36 forming a recess and a plurality of T-Interruptions 38 between each T-slot 36 in an alternation fashion. A T-nut 92 is shown extending into the guide groove 34. The T-nut 92 is connected to an adjustment bracket 90 that is connected to a horizontal stand 82 by an upper bracket clamp 88 and a lower bracket clamp 86. The deckle board 32 includes a deckle board clamp 40 and a seal strip clamp 42 that clamp a seal strip 44 that extend there between.

Figure 7:
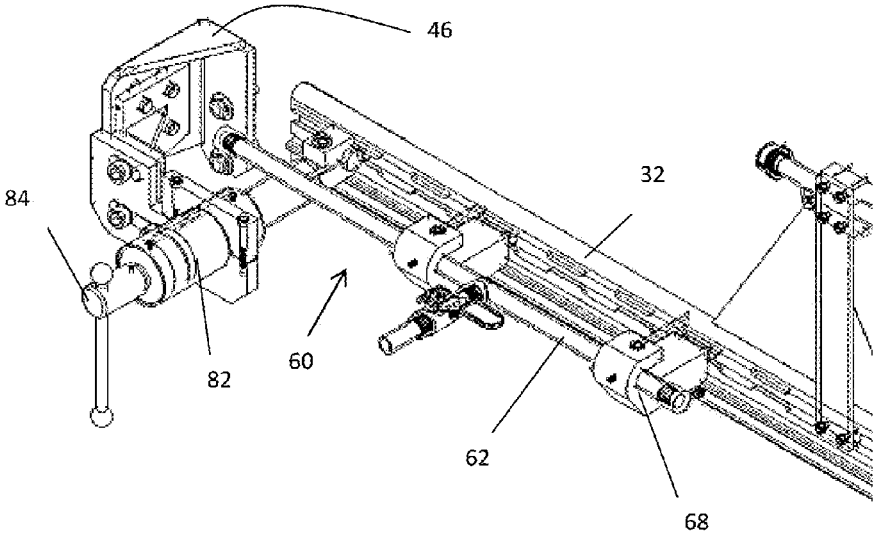
FIG. 7 illustrates a close-up perspective view of an end of the deckle system of FIG. 4A proximate to the head box.

FIG. 7 illustrates a close-up perspective view of an end of FIG. 4, the end being an end opposite that of FIG. 6. The end includes a head box attachment 46 for fixing the end proximate to the head box. A horizontal stand 82 has an adjustment device 84 that adjusts the deckle board 32. A shower system 62 is located next to the deckle board 32. A plurality of holders 68 extend from the deckle board 32 and connect a shower bar 62 within the system.

Figure 8:
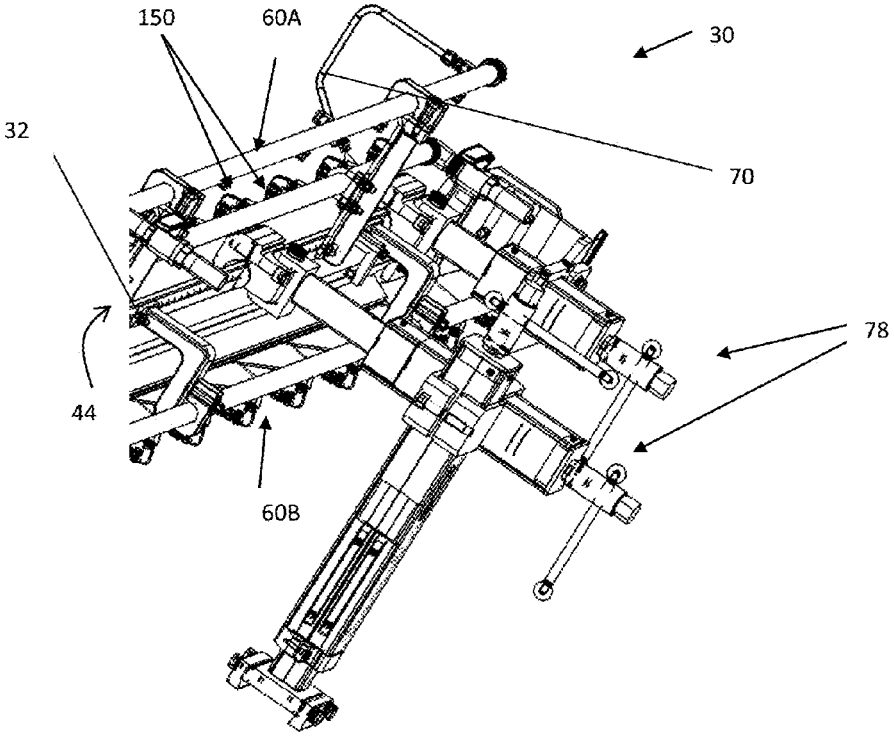
FIG. 8 illustrates a close-up perspective view of an end of a deckle system proximate to the head box.

FIG. 8 illustrates a close-up perspective view of an end of a deckle board system 30. The non-stock side of the deckle board system 30 is shown so that the stand assemblies 78 are shown connected to the deckle board 32. The deckle board system 30 includes an upper shower system 60A, a lower shower system 60B, a boundary layer shower 150, and end shower 70 (the opposing end also includes an end shower). The upper shower system 60A creates a continuous waterfall along a stock side surface of the deckle board 32. The lower shower system 60B sprays water proximate to the seal strip 44 so that the seal strip 44 remains clean and an end of the sheet (not shown) remains straight. The end shower 70 provides additional cleaning at the ends of the deckle board system 30. The boundary layer shower 150 sprays water along the stock side face of the deckle board 32 so that a boundary layer is formed between the face of the deckle board 32 and stock (not shown).

Figure 9:
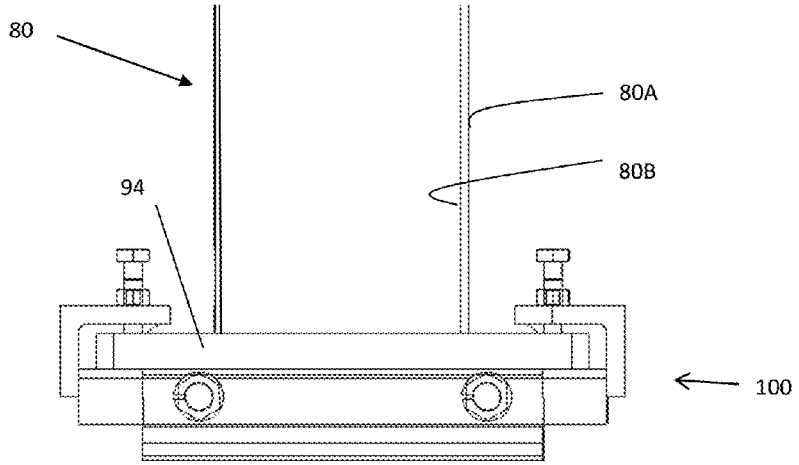
FIG. 9 illustrates a close-up view of a connection stand.

FIG. 9 illustrates a close up view of a connection stand 100 and example of a vertical stand 80. The vertical stand 80 includes a stand bracket 94 at the end that is fixedly connected to the inner tube 80B. An outer tube 80A extends around the inner tube 80B and the inner tube 80B provides support to the outer tube 80A. The outer tube 80A is vertically movable relative to the inner tube 80B without having to connect or disconnect the outer tube 80A from the inner tube 80B.

Figure 10:
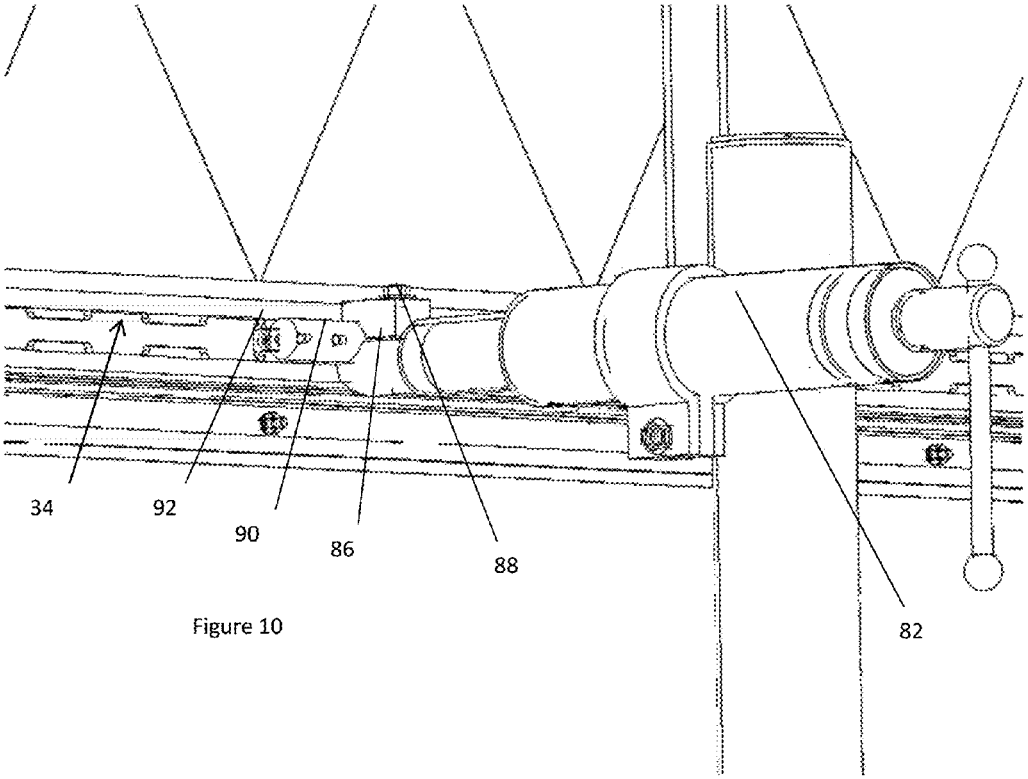
FIG. 10 illustrates a perspective view of non-stock side of the deckle system.

FIG. 10 illustrates a close up view of a connection between a guide groove 34 and a T-nut 92. The T-nut 92 is connected to an adjustment bracket 90 that is rotationally movable. The adjustment bracket 90 is connected to a horizontal stand 82 by an upper bracket clamp 88 and a lower bracket clamp 86.

Figure 11:
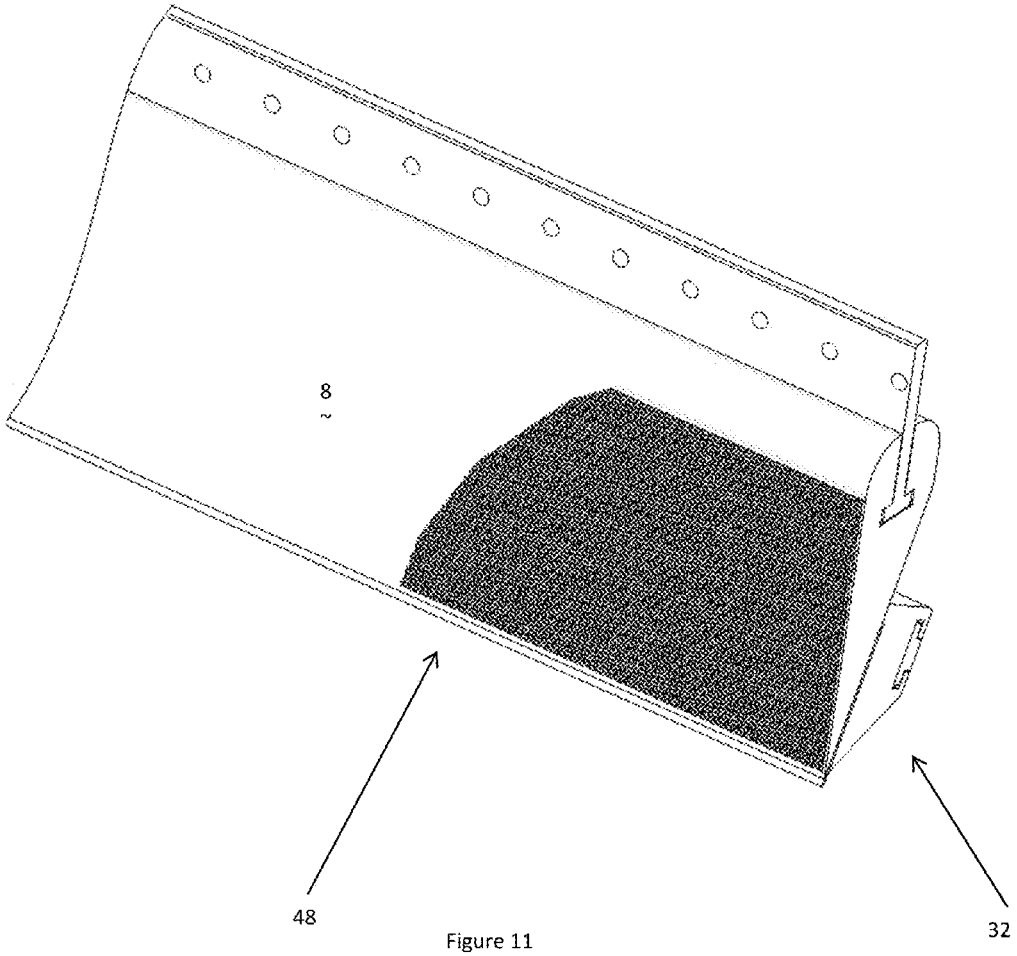
FIG. 11 illustrates a close-up view of the microstructure of a stock side face of a deckle board.

FIG. 11 illustrates a close-up view of a stock side 8 of a deckle board 32. The stock side 8 of the deckle board 32 includes a microstructure 48. For illustrative purposes only a microstructure 48 is shown next to a smooth surface.

Figure 12:
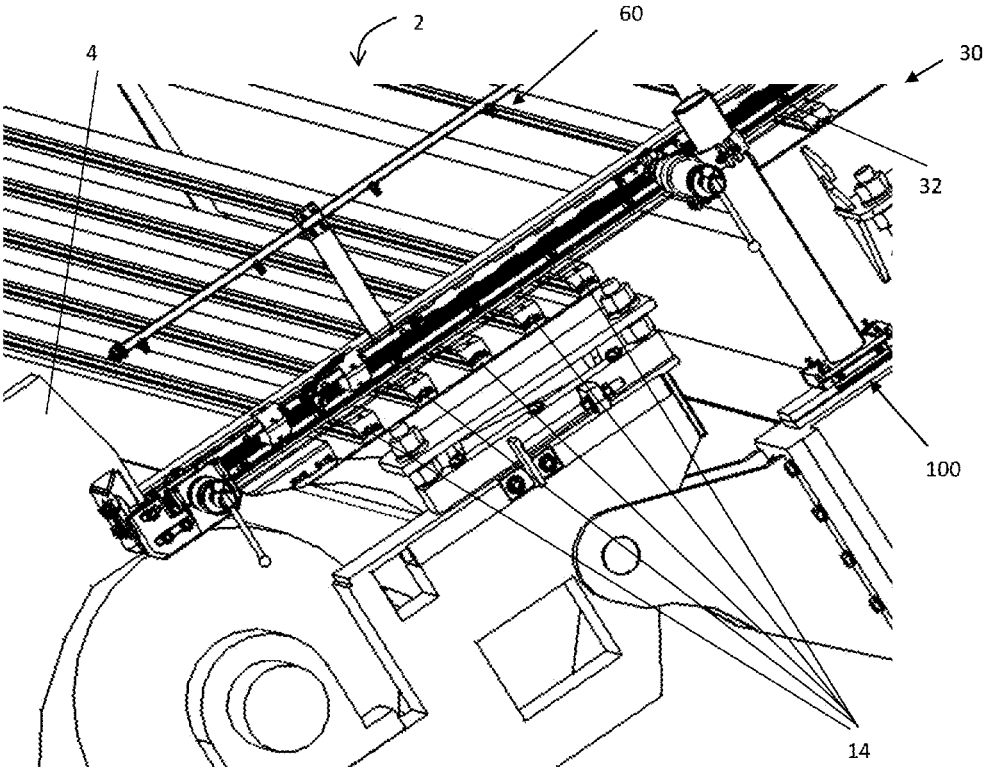
FIG. 12 illustrates a perspective view of the beginning of the paper machine and the deckle system facing in the machine direction.

FIG. 12 illustrates the deckle board system 30 connected to the head box 4. The shower system 60 is spraying water onto the top of the deckle board 32 so that the board is cleaned. The deckle board system 30 is located proximate to the end of the foils 14, but the foils 14 extend past the deckle board system 30. The connection stand 100 is slid onto the paper machine 2 so that a connection is formed.

Figure 13:
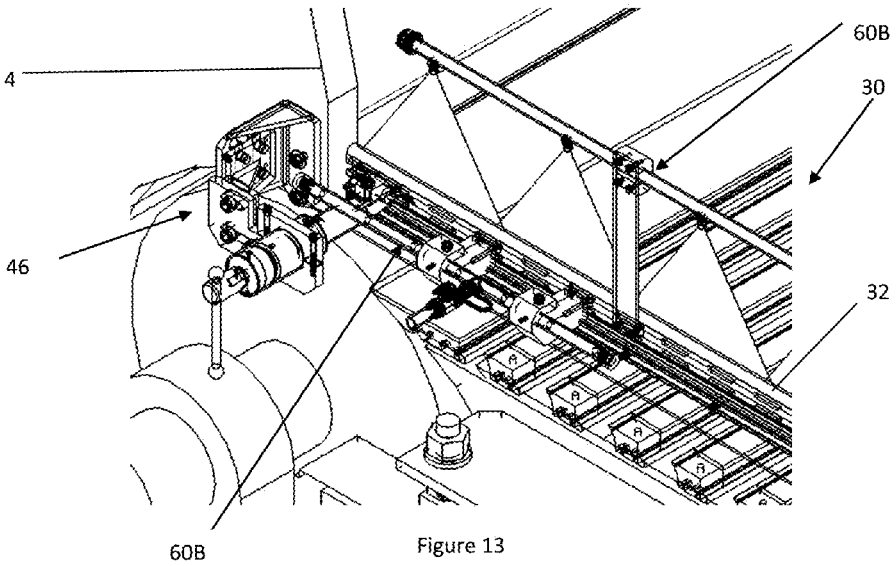
FIG. 13 illustrates a perspective view of the beginning of the paper machine and the deckle system facing towards the breast roll.

FIG. 13 illustrates a close up view of the deckle board system 30 of FIG. 12. The deckle board system 30 is connected to the head box 4 via the head box attachment 46. As shown a lower shower system 60B extends proximate to the deckle board 32 and is located under the upper shower system 60A. The lower shower system 60B sprays the non-stock side of the deckle board.

Figure 14:
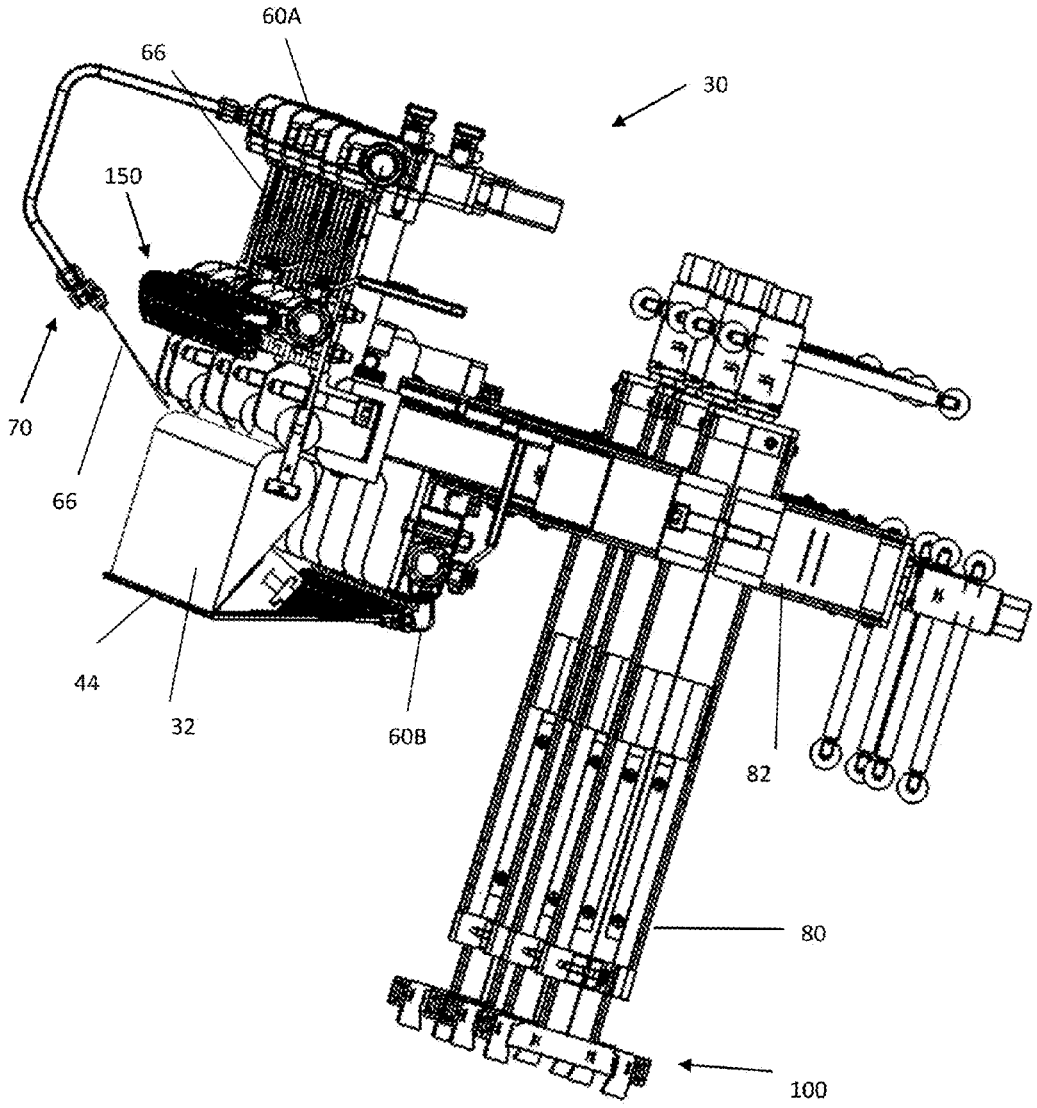
FIG. 14 illustrates a perspective view along the deckle system so that the adjustable showers all are shown.

FIG. 14 illustrates a perspective view taken from the stock side of the deckle board system 30. The deckle board system 30 includes a deckle board 32 and an upper shower system 60A that generates a spray 66 on the top of the deckle board 32 so that a continuous water fall is formed on the stock side of the deckle board. The deckle board system 30 includes a lower shower system 60B that generates a spray 66 that comes in contact with the seal strip 44 extending below the deckle board 32. The end of the deckle board 32 includes an end shower 70 to assist in cleaning the end from stock build up. A boundary layer shower 150 creates a spray (not shown) along the stock side of the of the deckle board 32.

Figure 15:
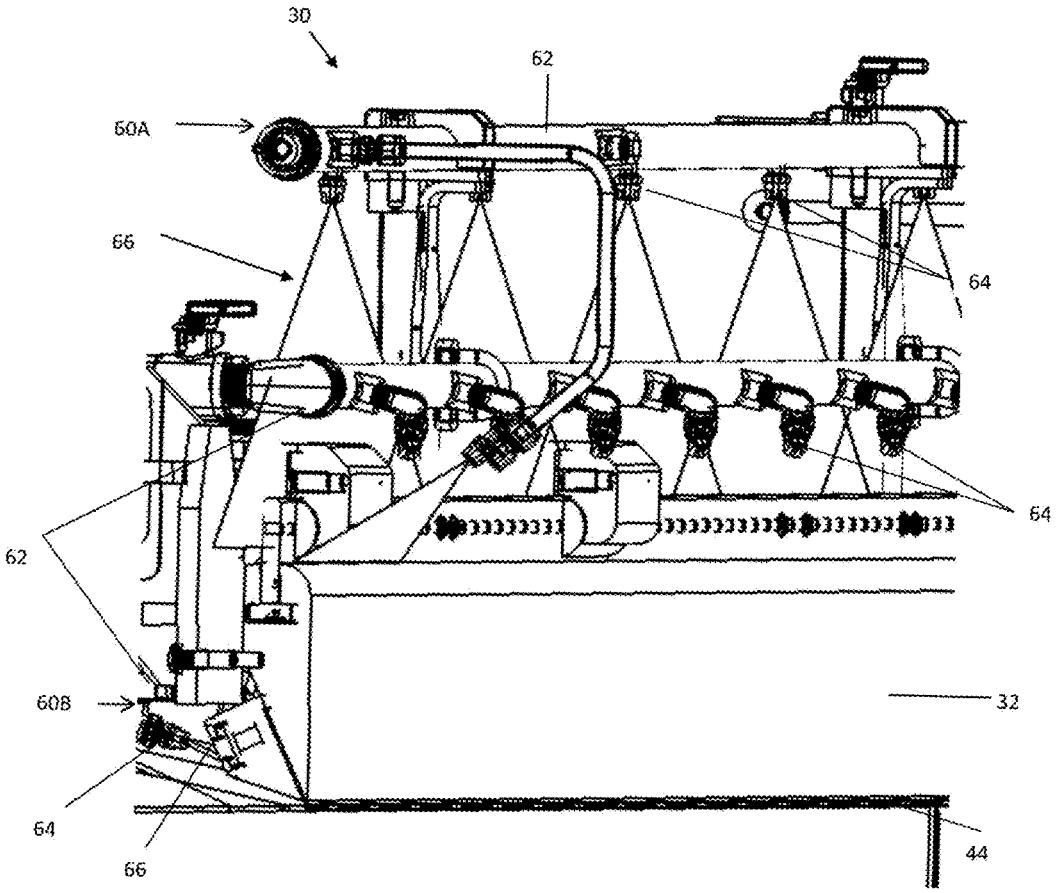
FIG. 15 illustrates a perspective end view of a stock side of a deckle board and seal strip.

FIG. 15 illustrates a close-up view of the stock side of the deckle board system 30. The deckle board system 30 includes an upper shower system 60A with a shower bar 62 and a plurality of nozzles 64 that direct a spray 66 behind the boundary layer shower 150 and onto the top of the deckle board 32. The boundary layer shower 150 includes a shower bar 62 and a plurality of shower nozzles 64 that are shown without a spray. The nozzles 64 of the boundary layer shower 150 spray water across the stock side of the deckle board 32. The lower shower system 60B has a spray 66 that sprays water on the non-stock side of the deckle board 32. The lower shower system 60B includes a shower bar 62 and a plurality of shower nozzles 64 that spray 66 the seal strip 44 to clean the seal strip 44 of the deckle board 32.

Figure 16:
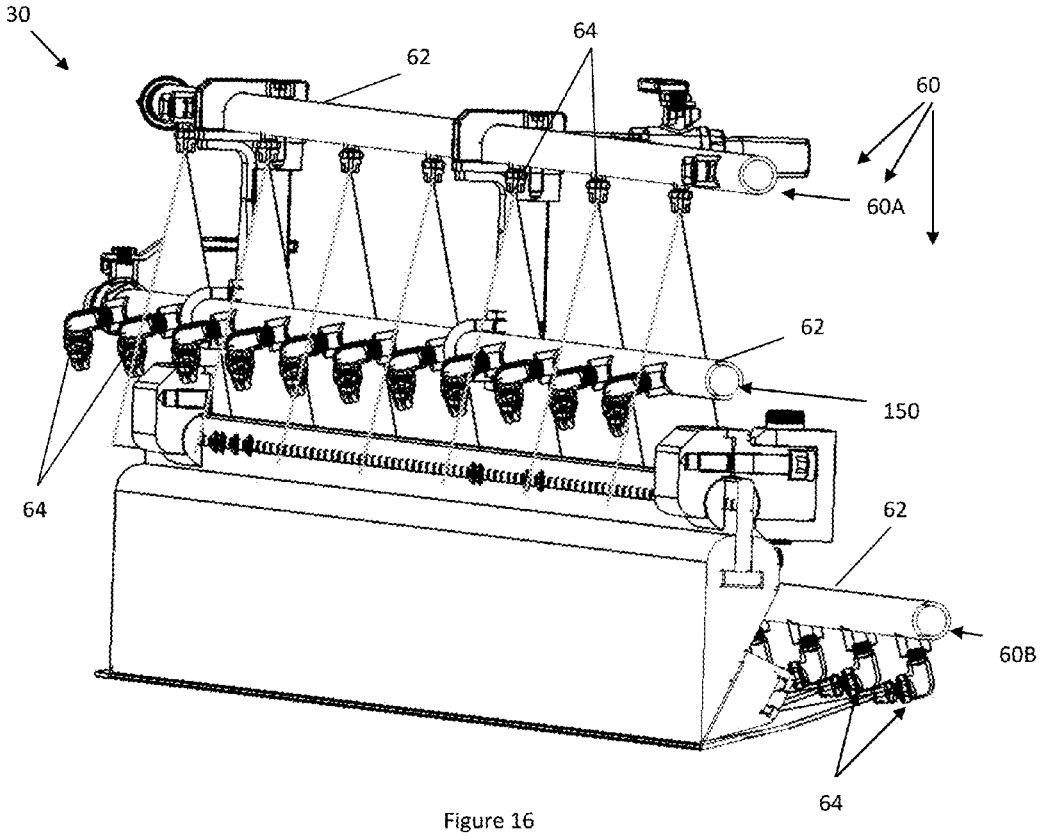
FIG. 16 illustrates a cross-sectional view of the deckle board system showing the bracket assembly and showers.

FIG. 16 illustrates a partial cross-sectional view of a deckle board system 30 and three shower system 60. The shower system 60 includes an upper shower system 60A, a lower shower system 60B, and a boundary lawyer shower 150. Each of the three shower systems 60 include a shower bar 62 an a plurality of nozzles 64.

Figure 17:
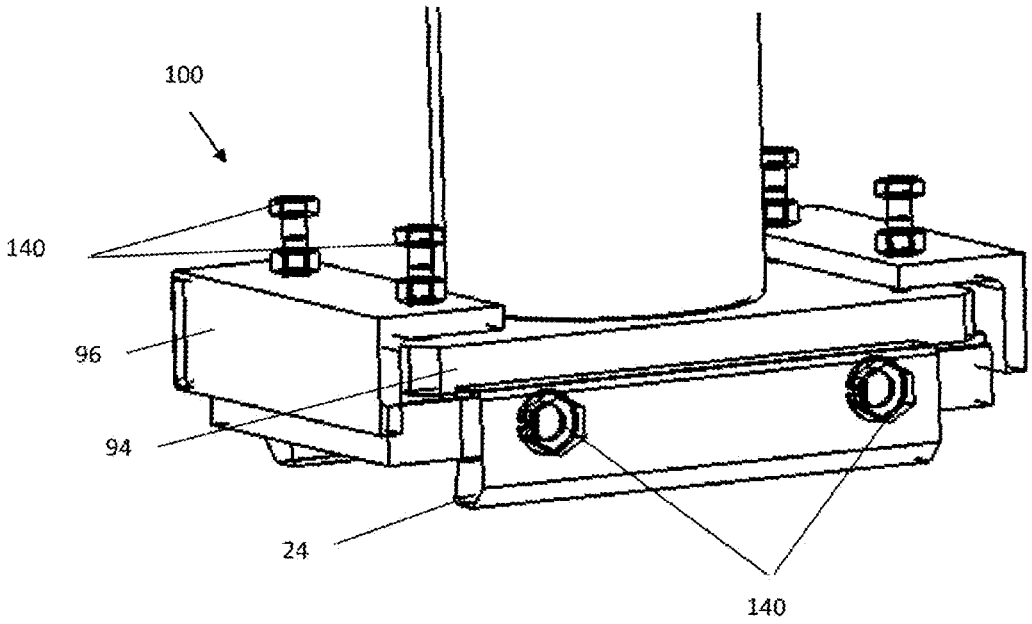
FIG. 17 illustrates a perspective view of a connection stand.

FIG. 17 illustrates a connection stand 100 for connecting the stand to a paper machine (not shown). The connection stand 100 receives a connection plate 24 that is connected to the paper machine by a plurality of fasteners 140. The connection stand 100 includes a stand bracket 94 that is in communication with the vertical stand 80 and connected to a pair of opposing angled brackets 96 by a plurality of fasteners 140.

Figure 18:
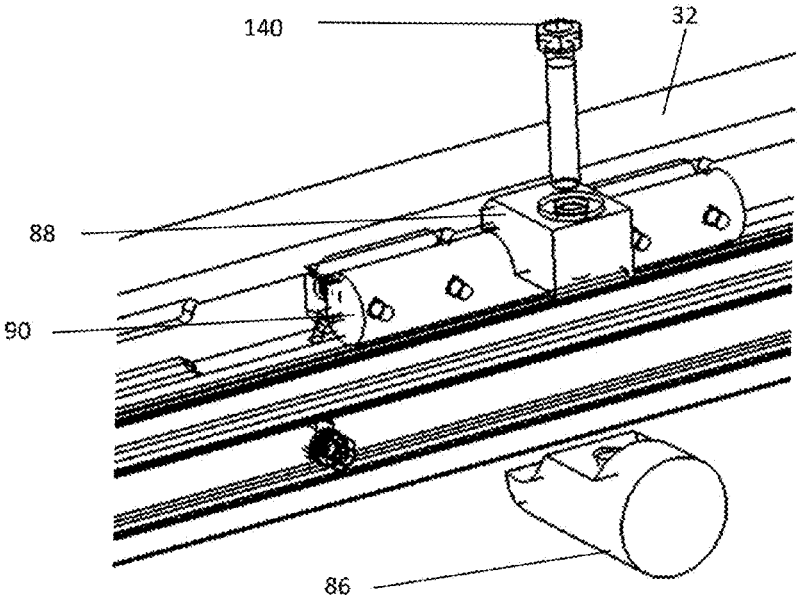
FIG. 18 illustrates a partial exploded view of a connection with a deckle board.

FIG. 18 illustrates a deckle board 32 and an adjustment bracket 90 connected to the deckle board 32. The adjustment bracket 90 is located between a lower bracket 86 and an upper bracket 88. A fastener 140 extends between the upper bracket 88 and the lower bracket 86 without passing through the adjustment bracket 90. The adjustment bracket 90 may be rotated about its axis (e.g., longitudinal axis or rotational axis) when the fastener 140 is loosened so that the deckle board 32 is angle adjustable relative to vertical.

Figure 19:
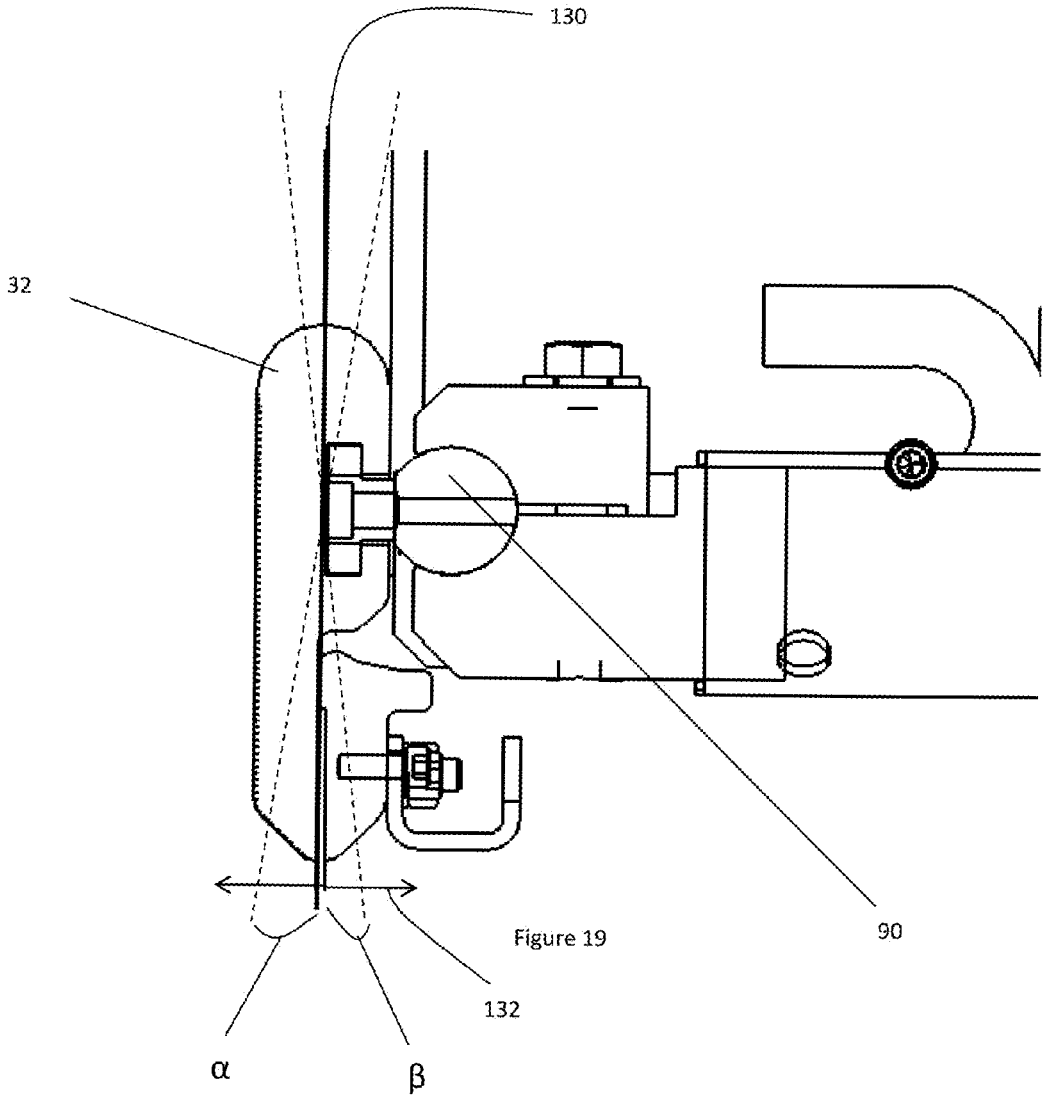
FIG. 19 illustrates an end view of a deckle board and angles of rotation of the deckle board.

FIG. 19 illustrates an end view of a deckle board 32. The deckle board 32 is aligned along a vertical plane 130. The adjustment bracket 90 is adjustable so that the deckle board is moved in the directions 132 so that an angle ($\alpha$) or an angle ($\beta$) can be formed between the deckle board 32 and the vertical plane 130. The angle ($\alpha$) or ($\beta$) can be adjusted so that turbulence is created, reduced, changed, eliminated, or a combination thereof on the surface of the deckle board 32, which prevents a boundary layer, waves, or both from being generated.

Figure 20:
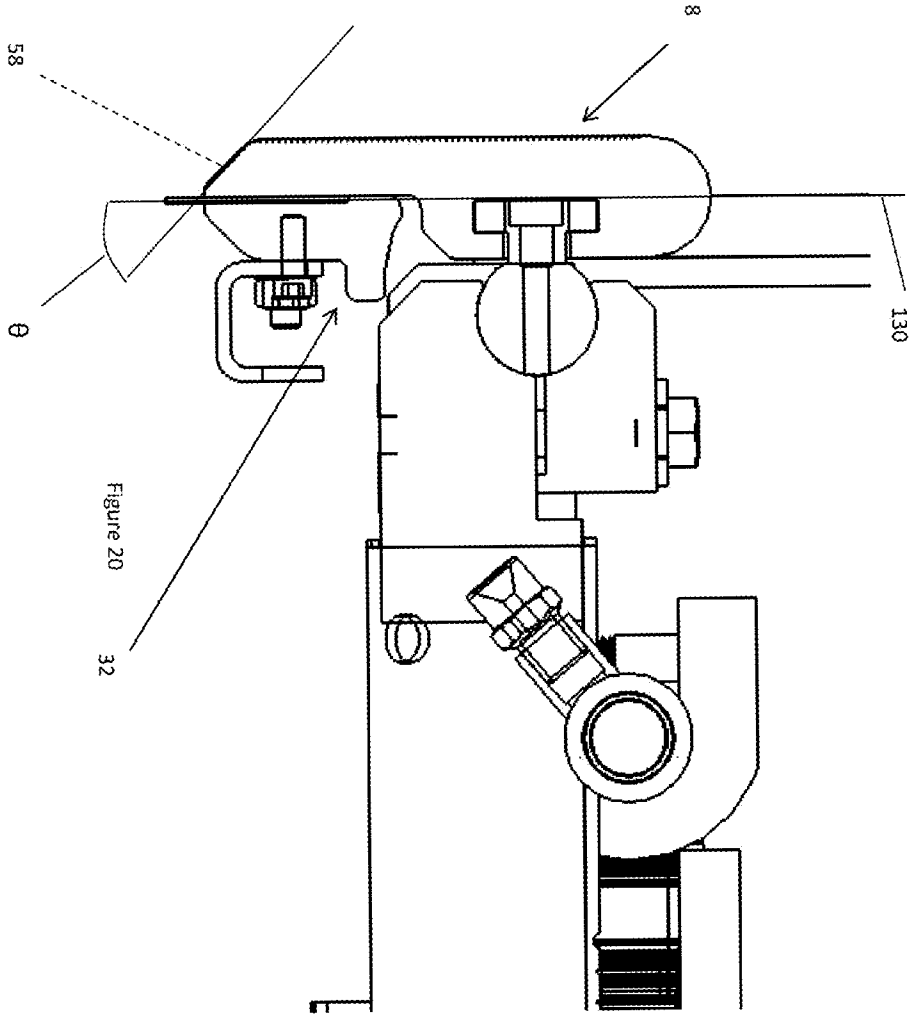
FIG. 20 illustrates an end view of a deckle board including an angle of the stock side of the deckle board.

FIG. 20 illustrates a deckle board 32 with a chamfer 58 formed in the stock side 8 of the deckle board 32. The chamfer 58 forms an angle ($\theta$) with a vertical plane 130. The chamfer 58 reduced and/or eliminates waves within the wet end of the paper machine (not shown).

Figure 21:
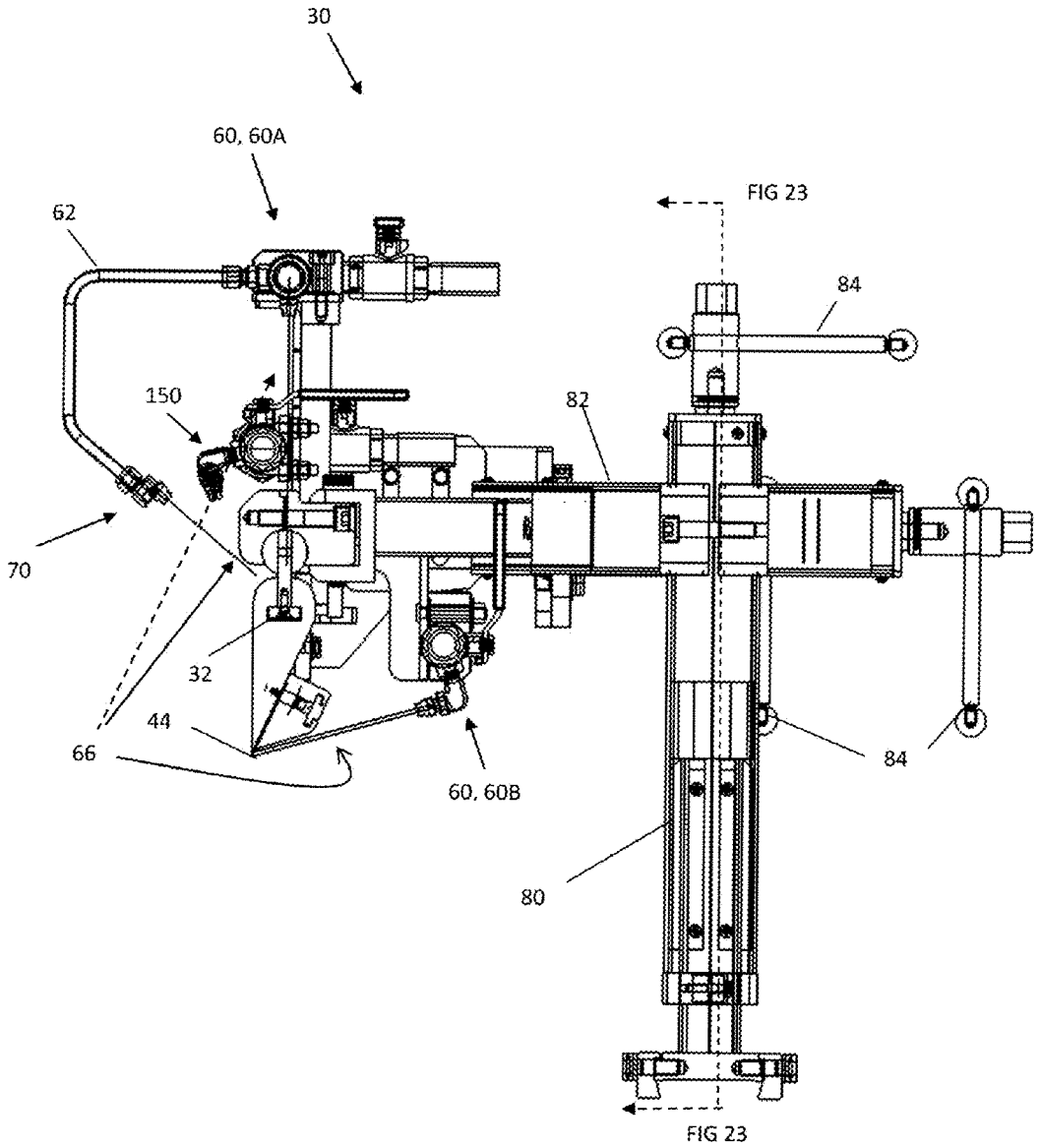
FIG. 21 illustrates an end view of a deckle board system.

FIG. 21 illustrates an end view of a deckle board system 30 including four shower systems 60. The four shower systems 60 include an end shower 70 that has a shower bar 62 that extends away from the deckle board 32 and then curves back towards the deckle board 32 so that a spray 66 is directed to the stock side of the deckle board for cleaning the deckle board 32. The end showers 70 are located at the two opposing ends of the deckle board system 30. An upper shower system 60A directs a spray 66 towards the top of the deckle board 32 so that a continuous waterfall of water flows across the stock side of the deckle board forming a boundary layer (not shown). The lower shower system 60B has a low angle spray 66 of water that is directed at or below the seal strip 44 on the non-stock side. The lower shower system 60B prevents stock build up on the seal strip 44 and assists in preventing waves from bouncing off of the seal strip 44 or the deckle board 32. A boundary lower shower 150 directs water across a face on the stock side of the deckle board 32. The deckle board 32 and four shower systems 60 are maintained in place by a plurality of vertical stands 80 and horizontal stands 82 that (as shown) are manually adjustable (as shown but could be automatically adjustable) by an adjustment device 84 connected to each of the respective stands.

Figure 22:
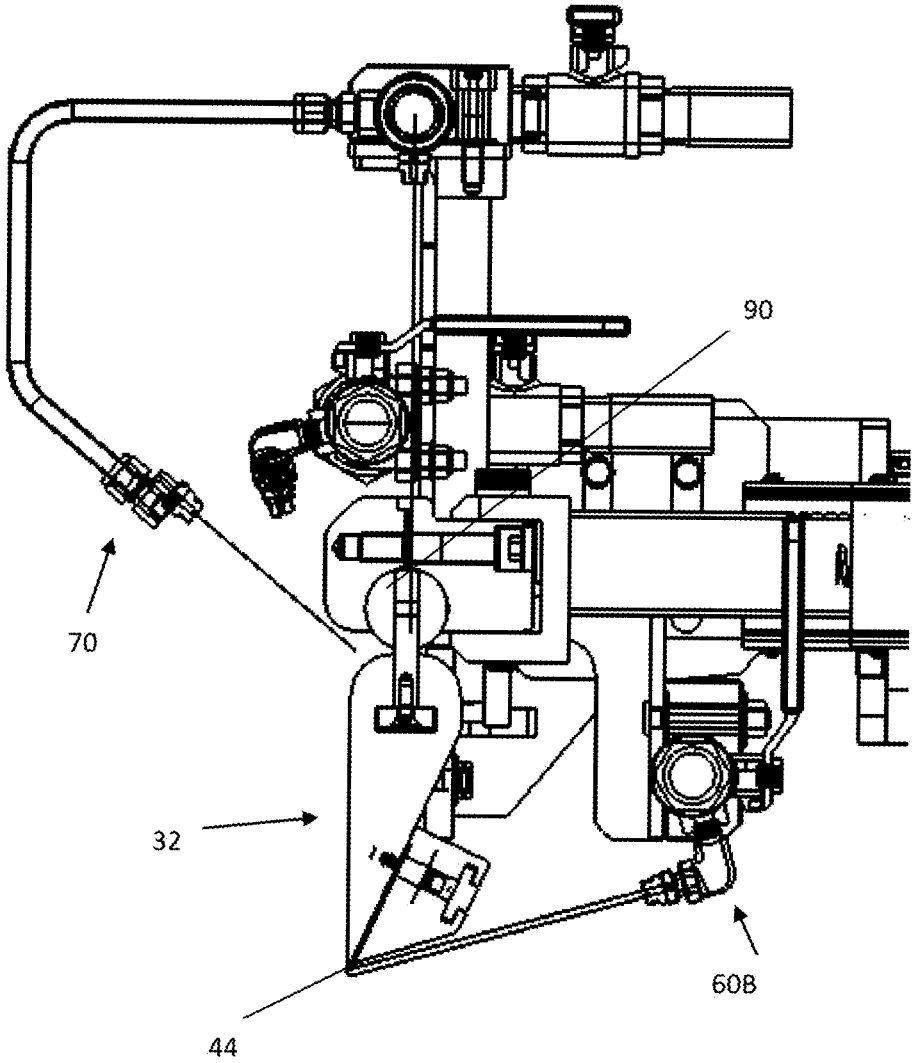
FIG. 22 illustrates a close-up view of the deckle board system of FIG. 21.

FIG. 22 illustrates a close up view of the end shower 70 and the lower shower system 60B with the spray 66 directed at the seal strip 44. As shown, the end shower 70 is directed to a top of the deckle board 32 on the stock side and the lower shower system 60B is directed to the bottom of the deckle board 32 and/or the seal strip 44 on the non-stock side. The deckle board 32 is adjusted via the adjustment bracket 90 so that the planar stock side of the deckle board 32 is substantially vertical or may be moved to form an angle other than 90 degrees with a wire of a paper machine (not shown) (e.g., about 85 degrees or more, about 95 degrees or less).

Figure 23:
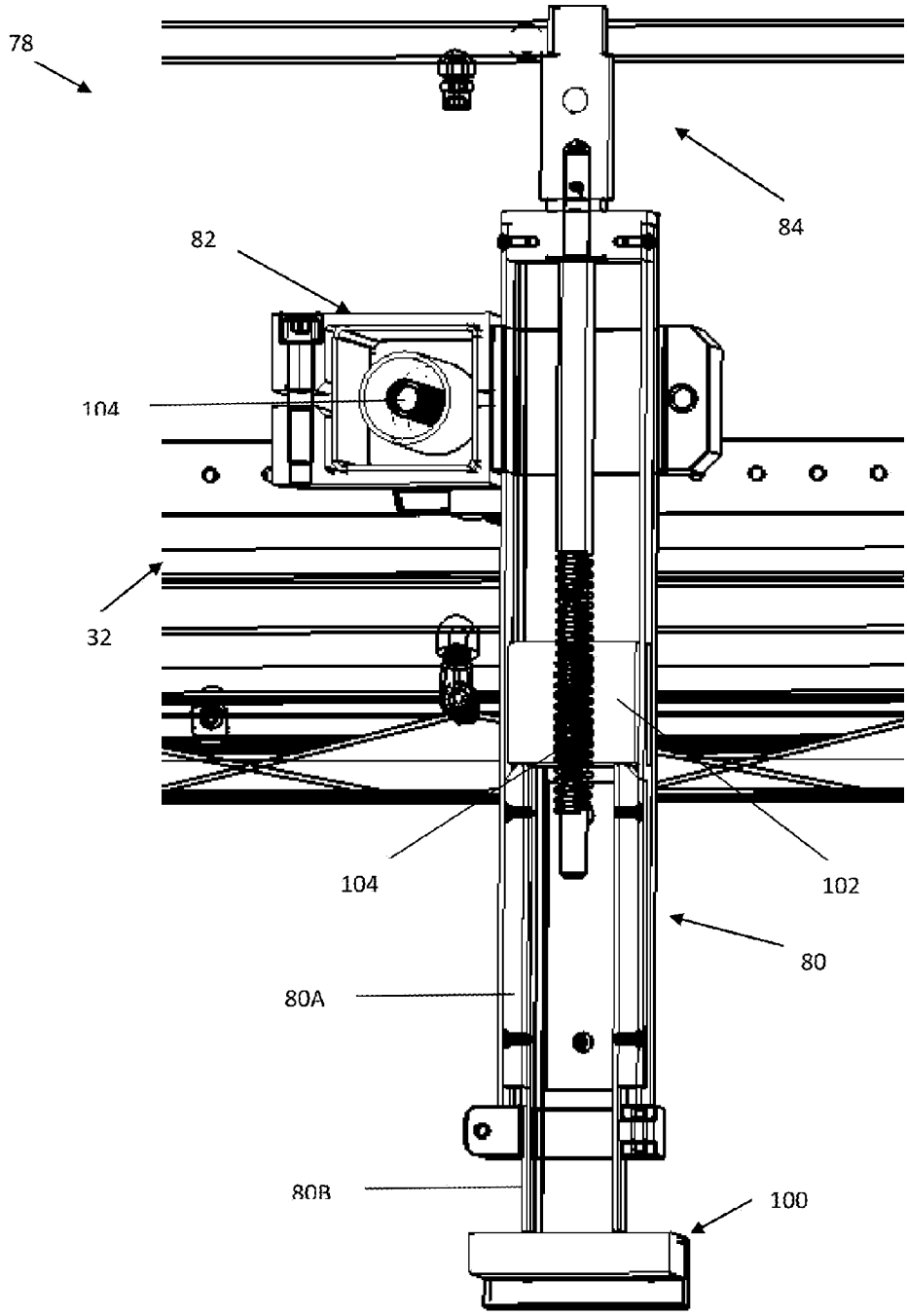
FIG. 23 illustrates a cross-sectional view of the vertical stand and the horizontal stand of FIG. 21.

FIG. 23 illustrates a cross-sectional view of the stand assembly 78. The stand assembly includes a connection stand 100, a vertical stand 80, and a horizontal stand 82. The vertical stand 80 is connected to the connection stand 100 and the vertical stand 80 includes an outer tube 80A and an inner tube 80B that are movable relative to each other. A lift plate 102 is connected to a top of the inner tube 80B and a movement member 104 is in communication with and extends between the lift plate 102 and the outer tube 80A so that the movement member pushes against the lift plate 102 and axially moves the outer tube 80A. As shown, the movement member 104 is connected to an adjustment device 94 so that as the length of the movement member 104 increases or decreases the height of the vertical stand 80 changes. The horizontal stand 82 includes a similar system to the vertical stand 80 and the movement member 104 is shown extending through the horizontal stand 82. Both the vertical stand 80 and the horizontal stand 82 adjust the position of the deckle board 32 on the paper machine (not shown).

Figure 24:
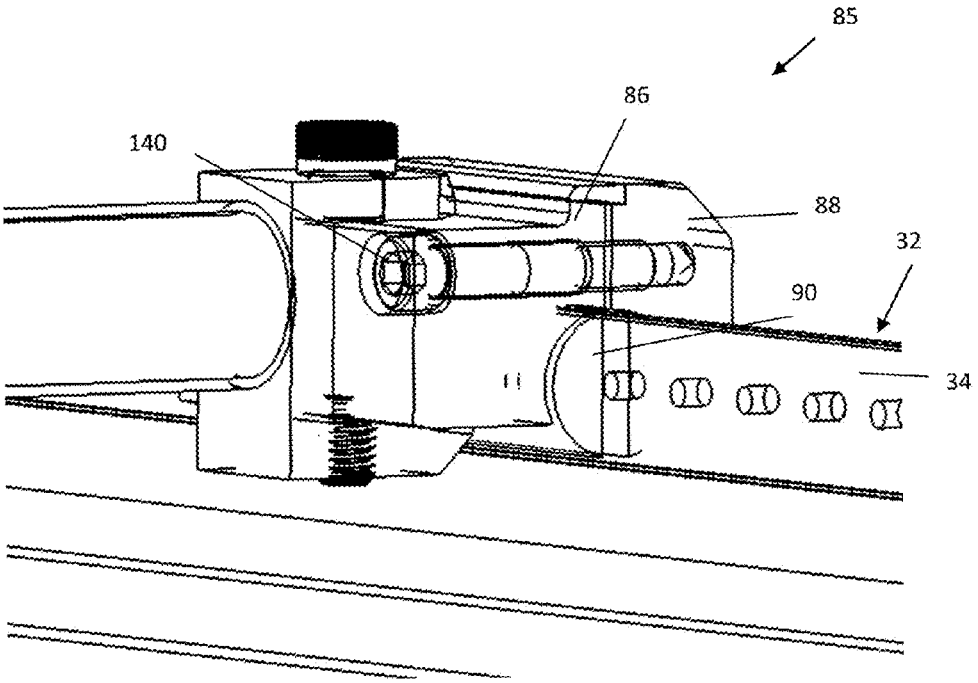
FIG. 24 illustrates a connection assembly connected to a deckle board.

FIG. 24 illustrates a rotation device 85 that includes a lower bracket clamp 86, an upper bracket clamp 88, and an adjustment bracket 90 located therebetween. The adjustment bracket 90 is connected to a guide groove 34 of the deckle board 32 and retained in place once a position is set by a plurality of fasteners 140 that extend between and connect the upper bracket clamp 88 to the lower bracket clamp 86.

Figure 25:
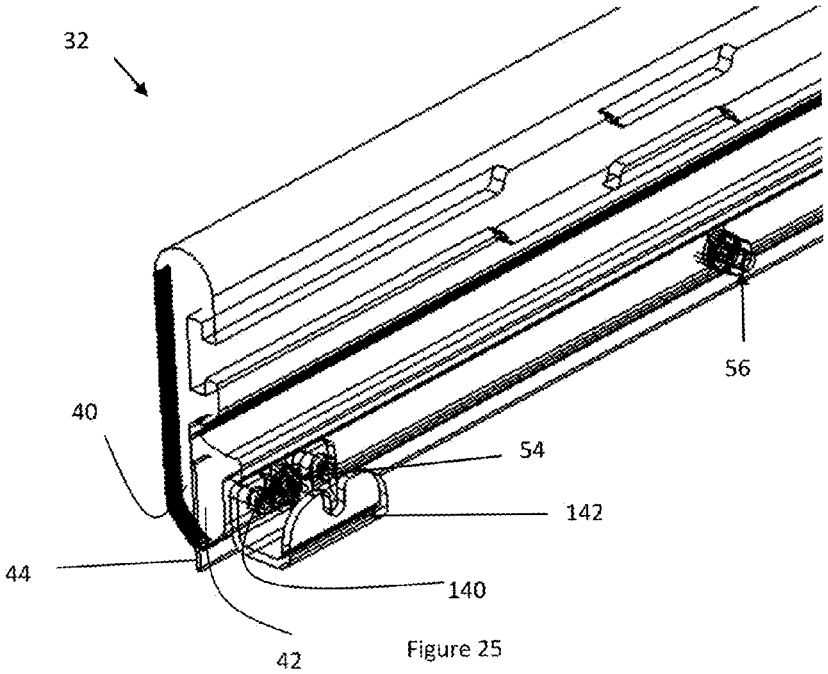
FIG. 25 illustrates a view of a non-stock side of a deckle board assembly.

FIG. 25 illustrates a perspective view of a non-stock side of a deckle board 32. The deckle board 32 includes a deckle board clamp 40 and a seal strip clamp bar 42 with a seal strip 44 located therebetween. The seal strip clamp bar 42 and the deckle board clamp 40 retain the seal strip 44 in place and allow for longitudinal movement of the seal strip 44 and deckle board 32 relative to each other. The seal strip clamp bar 42 and the deckle board clamp 40 are held in place by a connection fastener 54 that extend through the seal strip 44 so that the seal strip 44 is retained in place. A plurality of pressure fasteners 56 extend along the length of the deckle board 32 and assist in retaining the seal strip 44 between the seal strip clamp bar 42 and the deckle board clamp 40, but allow for longitudinal movement of the seal strip 44 relative to the deckle board 32. The amount of pressure applied to the seal strip 44 can be varied by loosening and tightening the pressure fasteners 56. An end of the deckle board 32 includes a fastener bracket 142 that is connected by a plurality of fasteners 140. The fastener bracket 142 assists in retaining fasteners on the deckle board 32.

Figure 26:
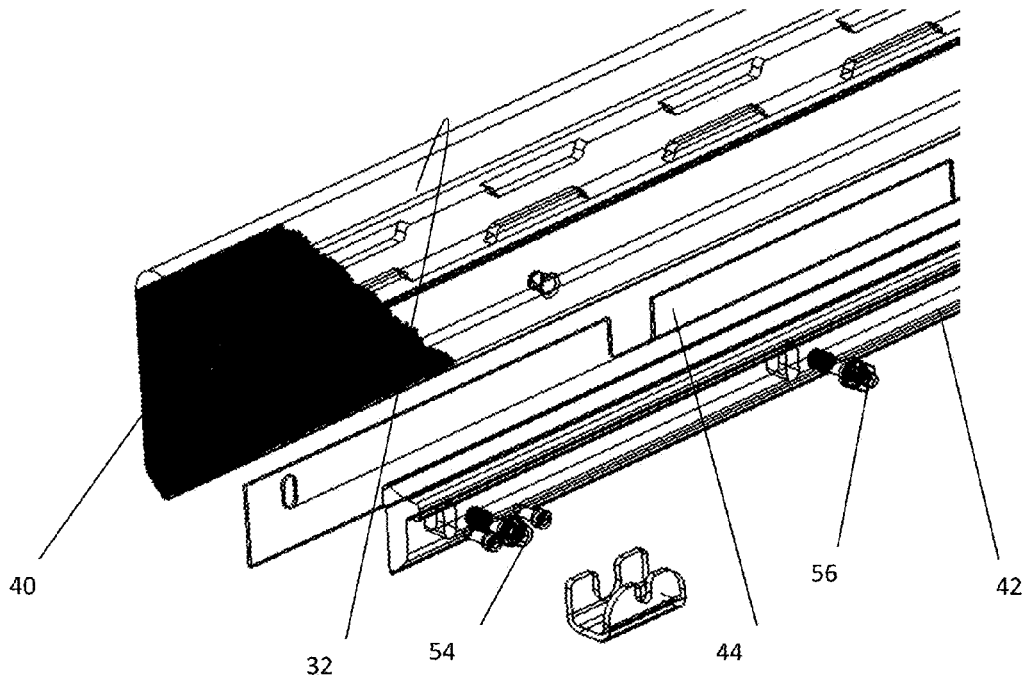
FIG. 26 illustrates a partial exploded view of a deckle board assembly.

FIG. 26 illustrates an exploded view of a deckle board 32. The seal strip clamp bar 42 is removed from the deckle board clamp 40 so that the seal strip 44 is exposed. The seal strip clamp bar 42 is connected to the deckle board clamp 40 and the seal strip 44 by a connection fastener 54 and a pressure fastener 56.

Figure 27:
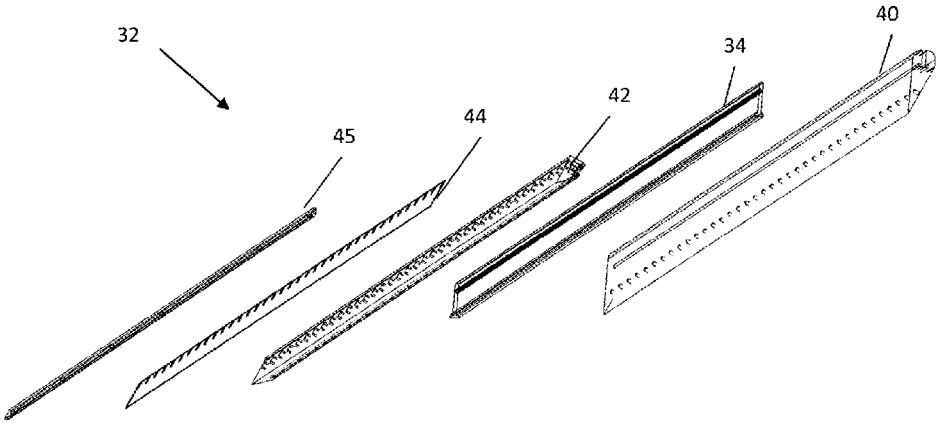
FIG. 27 illustrates an exploded view of the deckle assembly of FIG. 28.

FIG. 27 illustrates an exploded view of a deckle board 32. The deckle board 32 includes a deckle board clamp 40 that also contacts the stock for creating a deckled edge, a guide groove 34 that connects the deckle board clamp 40 to the paper machine (not shown), a seal strip clamp 42 that includes an internal pocket, a cover 45 that encloses the internal pocket in the seal strip clamp 42, and a seal strip 44 that is located between and retained in place by the seal strip clamp 42 and the deckle board clamp 40.

Figure 28:
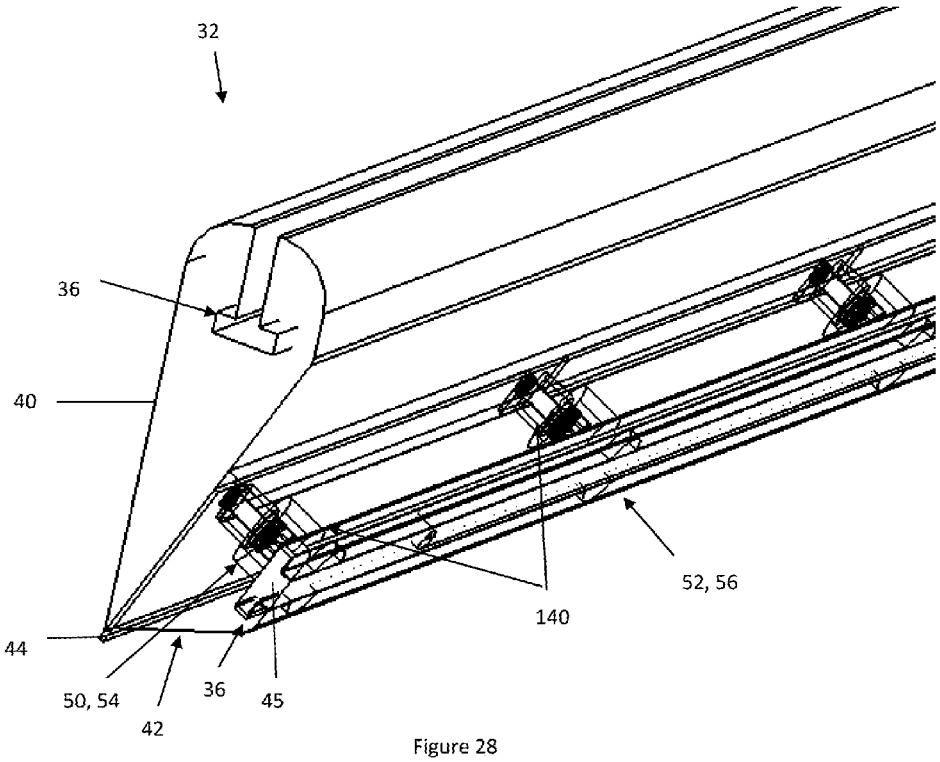
FIG. 28 illustrates a non-stock side view of a deckle board and associated hardware.

FIG. 28 illustrates a perspective view of the non-stock side of the deckle board 32. The deckle board 32 includes a deckle board clamp 40 having a T-slot 36. A seal strip clamp 42 is shown in transparent and is connected to the deckle board clamp 40. The seal strip clamp 42 shows an internal pocket that includes a plurality of fasteners 140 (i.e., connection fasteners 54 and a plurality of pressure fasteners 56) and has a cover 45 that, as shown, is closed by extending through a T-slot 36 so that the internal pocket is kept substantially dry and free of debris. The seal strip 44 is held in place between the deckle board clamp 40 and seal strip clamp 42, and the seal strip 44 includes a plurality of expansion slots 52 that allow the seal strip and/or deckle board clap 40 and seal strip clamp 42 to move relative to each other. The seal strip 44 also includes a connection slot 50 that retains the seal strip 44 in place and prevents the seal strip 44 from being removed from the deckle board 32.

Figures 29, 30:
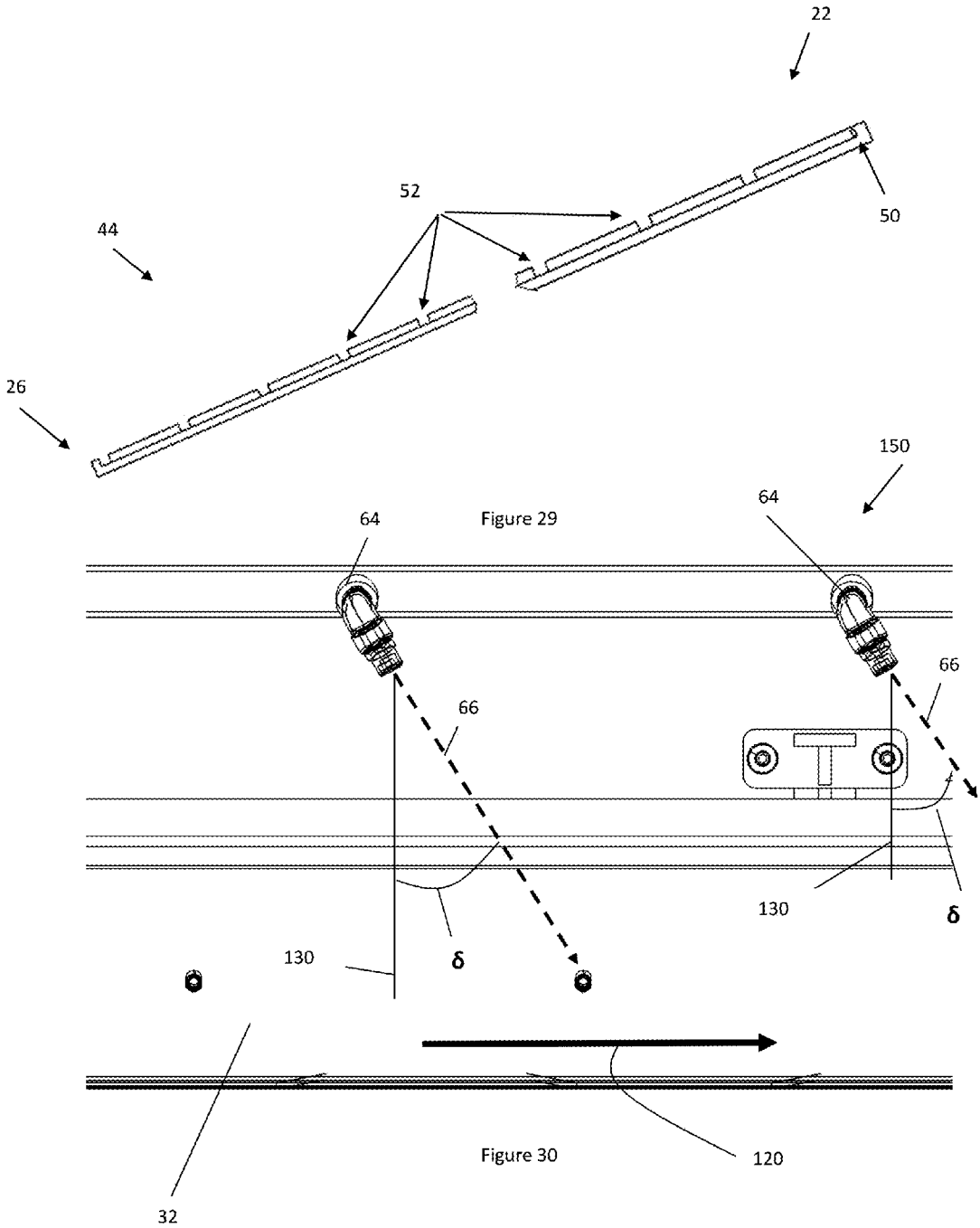
FIG. 29 illustrates end sections of the seal strip.
FIG. 30 illustrates a close up view of two shower nozzles of the boundary layer shower and the spray direction.

FIG. 29 illustrates a perspective view of ends of a seal strip 44. The head box end 22 includes a connection slot that prevents the seal strip 44 from being pulled in the machine direction 120 but allows for expansion and contraction of the deckle board 32. Expansion slots 52 extend from the head box end 22 to the couch roll end 26 so that substantially the entire length of the seal strip 44 is movable within the deckle board 32.

FIG. 30 illustrates a close-up view of two nozzles 64 in the boundary layer showers 150. The nozzles direct a spray 66 at an angle ($\delta$) relative to vertical 130 along the deckle board 32. As illustrated the spray 66 is directed in the machine direction 120.

Figure 31:
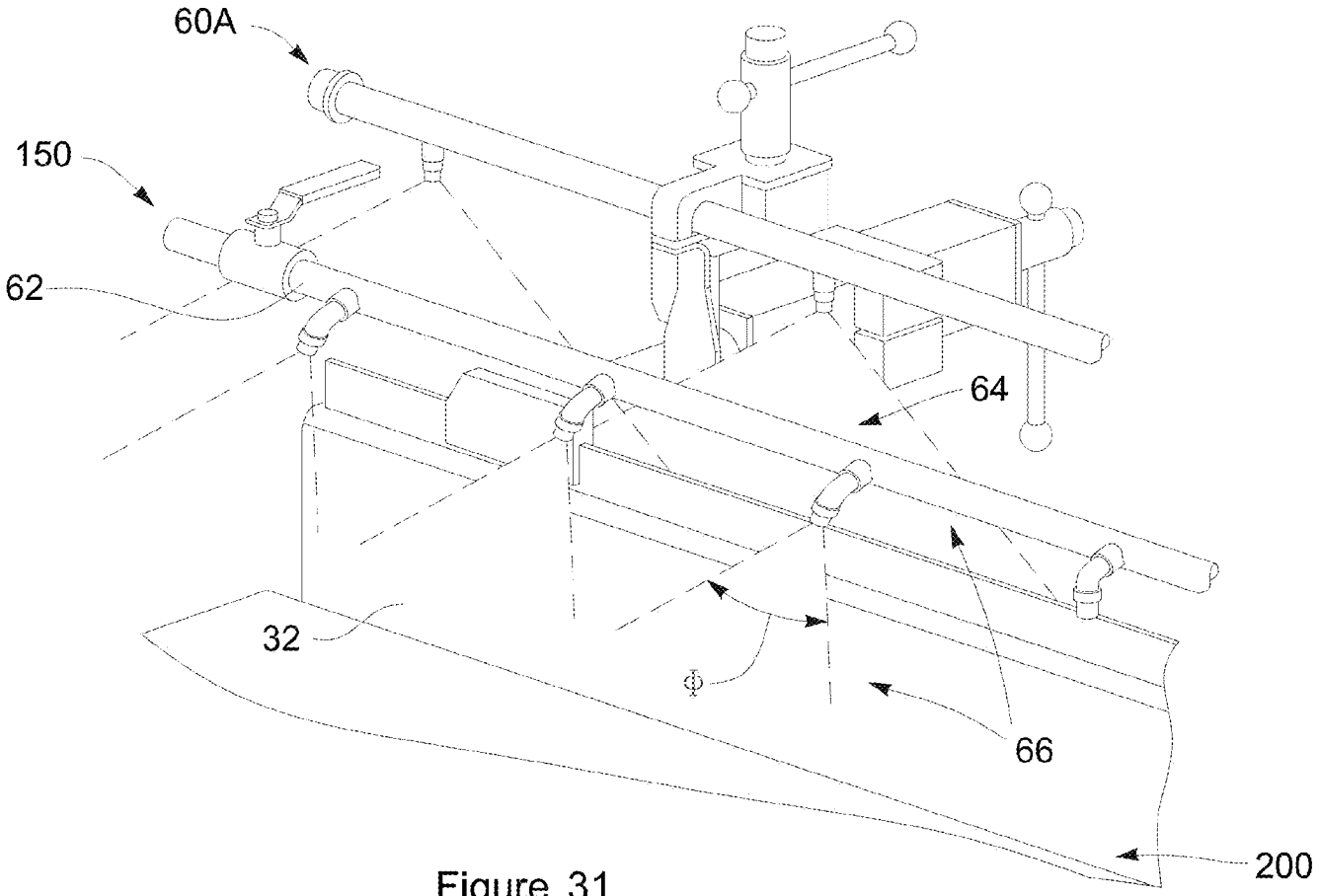
FIG. 31 illustrates the boundary layer shower spray extending at an angle out of the shower nozzles.

FIG. 31 illustrates the spray 66 of the upper shower system 60A extending behind the boundary layer shower 150. The boundary layer shower 150 includes a shower bar 62 with a plurality of shower nozzles 64 and each generate a spray 66 that fans at an angle ($\phi$) so that an area is covered and a boundary layer 200 is formed at the base of the deckle board 32.

Figure 32:
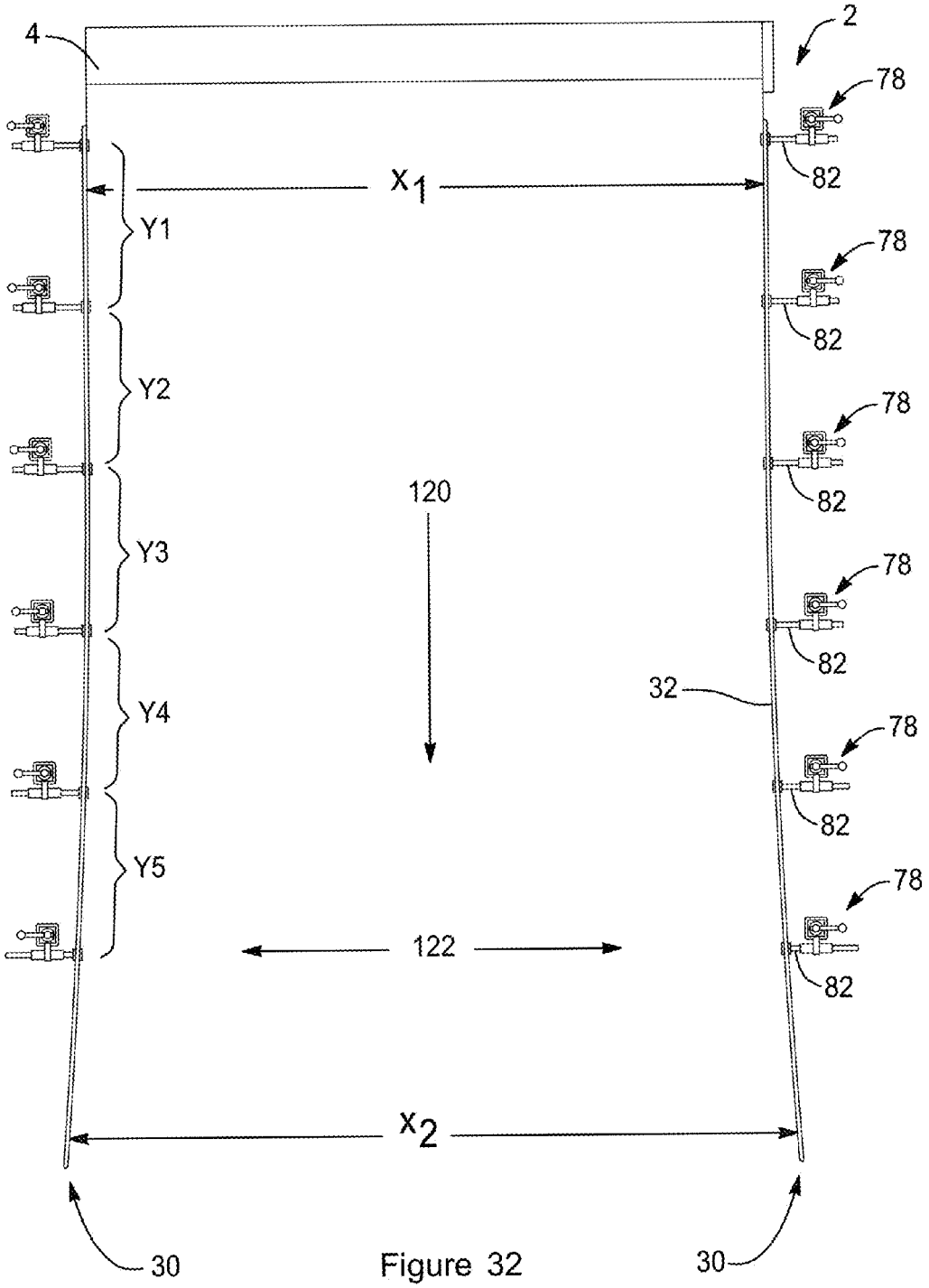
FIG. 32 illustrates a top view of a paper machine with the deckle board system curved outward.

FIG. 32 illustrates a top view of the paper machine 2 with a deckle board system 30 on each side of the paper machine 2. Each of the deckle board systems 30 include a deckle board 32 that curves outward as the deckle boards 32 extend away from the headbox 4 in the machine direction 120. The deckle boards 32 are connected to a stand assembly 78. Each of the stand assemblies 78 include a horizontal stand 82 that extends cantilever and supports the deckle board 32. As shown, a distance the horizontal stands 82 extend outward is reduced as the stand assemblies 78 extend in the machine direction 120. The reduction in the distance of the horizontal stands 82 results in a cross machine direction 122 increasing from ($X_1$) to ($X_2$) where ($X_2$) is greater than ($X_1$). The deckle boards 32 are pliable and generally form a continuous curve as the deckle boards 32 extend in the machine direction. The deckle boards 32 has a varying slope as the deckle boards 32 extend in the machine direction 120. The stand assemblies 78 are adjusted to change the curve and/or slope of the deckle boards 32. The deckle board has a first slope ($Y_1$), a second slope ($Y_2$), third slope ($Y_3$), fourth slope ($Y_4$), and a fifth slope ($Y_5$). As shown the slope ($Y_1$) and ($Y_2$) are the same. As the deckle board extends in the machine direction 120 the slope increases such that the slope of $Y_5$ has the greatest slope.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of or even consists of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

We claim:

1. A system comprising:

one or more deckle boards that extend along a machine direction of a paper machine, and a boundary layer shower including a plurality of shower nozzles, the boundary layer shower being located proximate to each of the one or more deckle boards and directing a fluid onto a stock side face of the one or more deckle boards so that a boundary layer of fluid is formed between the one or more deckle boards and stock;

wherein the plurality of shower nozzles extend out over the one or more deckle boards and direct the fluid back towards the one or more deckle boards.

2. The system of claim 1, wherein each of the plurality of shower nozzles direct the fluid substantially in the machine direction.

3. The system of claim 2, wherein the plurality of shower nozzles direct fluid at an angle of about 10 degrees or more from vertical in the machine direction.

4. The system of claim 2, wherein the plurality of shower nozzles direct fluid at an angle of about 30 degrees or more from vertical in the machine direction.

5. The system of claim 2, wherein the plurality of shower nozzles fan the fluid and the fan extends at an angle of about 25 degrees or more, and the boundary layer of fluid eliminates waves within the stock on the paper machine.

6. The system of claim 1, wherein the fluid is directed onto the face of the deckle board and substantially in the machine direction so that the fluid runs down the face of the deckle board.

7. The system of claim 1, wherein the deckle board is free of substantially smooth segments or smooth portions at any point along the face of the deckle board.

8. The system of claim 1, wherein the boundary layer of fluid cleans the stock side face of the deckle board.

9. The system of claim 1, wherein the boundary layer of fluid prevents stock from directly contacting the deckle board.

10. The system of claim 1, wherein the fluid is expelled from the boundary layer shower at substantially the same speed as the machine speed.

11. The system of claim 10, wherein fluid when moved into contact with stock facilitates movement of the stock in the machine direction by creating turbulence along the stock side face of the one or more deckle boards.

12. A system comprising:

two deckle board that extend along opposing sides of a paper machine in a machine direction of the paper machine, and a boundary layer shower that is located proximate to each of the two deckle boards and directs a fluid unto a stock side face of the two deckle boards so that a boundary layer of fluid is formed between each the deckle boards and stock;

wherein one or both of the two deckle boards move in a cross-machine direction as the two deckle boards extend in the machine direction of the paper machine so that a distance between the two deckle boards increases.

13. The system of claim 1, wherein one or both of the two deckle boards form a curve in the machine direction so that the distance between the two deckle boards increases more rapidly as the two deckle boards extend in the machine direction.

14. The system of claim 12, wherein one or both of the two deckle boards is made of a pliable material that flexes and forms a curve.

15. The system of claim 12, wherein each of the two deckle boards are connected to a plurality of stand assemblies that each include a vertical stand and a horizontal stand, and the horizontal stand extends outward from the vertical stand and supports each of the two deckle boards and a length the horizontal stands extend from the vertical stands decreases as the deckle board extends in the machine direction.

16. The system of claim 12, wherein the system includes an upper shower system that directs water on a top of each of the two deckle boards, the upper shower system being located above the boundary layer shower.

17. The system of claim 12, wherein the system includes a lower shower system that directs a fluid to a non-stock side of each of the two deckle boards.

18. The system of claim 1, wherein the system includes an upper shower system that directs water on a top of each of the two deckle boards, the upper shower system being located above the boundary layer shower, and the system includes a lower shower system that directs a fluid to a non-stock side of each of the two deckle boards.

19. A method comprising:

a. attaching the system of claim 1 to the paper machine;

b. adjusting each of a plurality of stand assemblies so that a distance of each of the deckle boards from a vertical stand of each of the plurality of stand assemblies decreases relative to the stand assemblies upstream so that the deckle boards diverge in the cross-machine direction as the deckle boards extend in the machine direction.

* * * * *